US010434379B2

(12) United States Patent
Brunski et al.

(10) Patent No.: US 10,434,379 B2
(45) Date of Patent: Oct. 8, 2019

(54) GOLF CLUB HEAD

(71) Applicant: SUMITOMO RUBBER INDUSTRIES, LTD., Kobe (JP)

(72) Inventors: Jeff D. Brunski, Los Angeles, CA (US); Samuel G. Lacey, Huntington Beach, CA (US); Dan S. Nivanh, Long Beach, CA (US); Nathaniel J. Radcliffe, Huntington Beach, CA (US); John J. Rae, Westminster, CA (US); Mark Blumenkrantz, Huntington Beach, CA (US); Rory C. Stewart, Costa Mesa, CA (US); Michael J. Wallans, Huntington Beach, CA (US)

(73) Assignee: SRI SPORTS LIMITED, Kobe-shi (JP)

( * ) Notice: Subject to any disclaimer, the term of this patent is extended or adjusted under 35 U.S.C. 154(b) by 0 days.

(21) Appl. No.: 15/379,077

(22) Filed: Dec. 14, 2016

(65) Prior Publication Data

US 2017/0087428 A1 Mar. 30, 2017

Related U.S. Application Data

(63) Continuation of application No. 14/222,206, filed on Mar. 21, 2014, now abandoned, which is a (Continued)

(51) Int. Cl.
*A63B 53/04* (2015.01)

(52) U.S. Cl.
CPC .. *A63B 53/0466* (2013.01); *A63B 2053/0408* (2013.01); *A63B 2053/0416* (2013.01); *A63B 2053/0458* (2013.01)

(58) Field of Classification Search
USPC ..... 473/324–350
See application file for complete search history.

(56) References Cited

U.S. PATENT DOCUMENTS 5,028,049 A 7/1991 McKeighen
5,094,383 A 3/1992 Anderson et al.
(Continued)

FOREIGN PATENT DOCUMENTS

JP 04241882 A * 8/1992 ..... A63B 53/04
JP 08155060 A * 6/1996
(Continued)

OTHER PUBLICATIONS

May 4, 2016 Office Action Issued in U.S. Appl. No. 14/222,206.

*Primary Examiner* — Alvin Hunter
(74) *Attorney, Agent, or Firm* — Oliff PLC

(57) ABSTRACT

A golf club head according to one or more aspects of the present invention may include a face portion or strike-face wall comprising a top inner boundary, an intermediate inner boundary, and a bottom inner boundary having a bottom-inner-boundary toe portion and a bottom-inner-boundary heel portion. The strike-face wall may further include a first uniform-thickness region, adjoining the top inner boundary, and a variable-thickness region adjoining the uniform-thickness region and a majority of the bottom inner boundary. In another example, the variable-thickness may adjoin a majority of the top inner boundary and the uniform-thickness region may adjoin a majority of the bottom inner boundary.

20 Claims, 28 Drawing Sheets

Related U.S. Application Data continuation of application No. 12/900,899, filed on Oct. 8, 2010, now Pat. No. 8,715,107.

(60) Provisional application No. 61/258,011, filed on Nov. 4, 2009.

(56) References Cited

U.S. PATENT DOCUMENTS

| | | | | |
|---|---|---|---|---|
| RE34,925 | E | 5/1995 | McKeighen | |
| 5,474,296 | A * | 12/1995 | Schmidt | A63B 53/04 473/346 |
| 5,482,279 | A * | 1/1996 | Antonious | A63B 53/04 473/327 |
| 5,584,770 | A | 12/1996 | Jensen | |
| 5,643,104 | A | 7/1997 | Antonious | |
| 5,755,627 | A | 5/1998 | Yamazaki et al. | |
| 5,762,567 | A | 6/1998 | Antonious | |
| 5,830,084 | A | 11/1998 | Kosmatka | |
| 5,954,596 | A * | 9/1999 | Noble | A63B 53/02 473/346 |
| 6,050,904 | A | 4/2000 | Kuo | |
| 6,193,614 | B1 | 2/2001 | Sasamoto et al. | |
| 6,315,678 | B1 * | 11/2001 | Teramoto | A63B 53/00 473/291 |
| 6,319,150 | B1 | 11/2001 | Werner et al. | |
| 6,348,013 | B1 | 2/2002 | Kosmatka | |
| 6,402,637 | B1 | 6/2002 | Sasamoto et al. | |
| 6,508,722 | B1 * | 1/2003 | McCabe | A63B 53/04 473/330 |
| 6,652,391 | B1 * | 11/2003 | Kubica | A63B 53/02 473/345 |
| 6,659,884 | B2 | 12/2003 | Knuth | |
| 6,663,506 | B2 | 12/2003 | Nishimoto et al. | |
| 6,800,039 | B1 | 10/2004 | Tseng | |
| 6,926,618 | B2 * | 8/2005 | Sanchez | A63B 53/04 473/329 |
| 7,018,303 | B2 | 3/2006 | Yamamoto | |
| 7,097,572 | B2 | 8/2006 | Yabu | |
| 7,137,907 | B2 * | 11/2006 | Gibbs | A63B 53/0466 473/329 |
| 7,220,190 | B2 | 5/2007 | Hirano | |
| 7,258,626 | B2 * | 8/2007 | Gibbs | A63B 53/04 473/329 |
| 7,278,925 | B2 | 10/2007 | Oyama | |
| 7,303,488 | B2 * | 12/2007 | Kakiuchi | A63B 53/0466 473/345 |
| 7,361,099 | B2 * | 4/2008 | Rice | A63B 53/0466 473/329 |
| 7,364,513 | B2 | 4/2008 | Krumme | |
| 7,387,577 | B2 | 6/2008 | Murphy et al. | |
| 7,390,269 | B2 | 6/2008 | Williams et al. | |
| 7,399,237 | B2 | 7/2008 | Evans et al. | |
| 7,402,112 | B2 | 7/2008 | Galloway | |
| 7,407,448 | B2 | 8/2008 | Stevens et al. | |
| 7,419,440 | B2 | 9/2008 | Williams et al. | |
| 7,422,527 | B2 | 9/2008 | Rice et al. | |
| 7,422,528 | B2 | 9/2008 | Gibbs et al. | |
| 7,431,664 | B2 | 10/2008 | Meyer et al. | |
| 7,435,189 | B2 | 10/2008 | Hirano | |
| 7,435,191 | B2 * | 10/2008 | Tateno | A63B 53/0466 473/346 |
| 7,438,647 | B1 | 10/2008 | Hocknell | |
| 7,442,132 | B2 | 10/2008 | Nishio | |
| 7,448,960 | B2 | 11/2008 | Gibbs et al. | |
| 7,448,963 | B2 | 11/2008 | Beach et al. | |
| 7,452,287 | B2 | 11/2008 | Erickson et al. | |
| 7,455,597 | B2 | 11/2008 | Matsunaga | |
| 7,455,598 | B2 | 11/2008 | Williams et al. | |
| 7,455,600 | B2 | 11/2008 | Imamoto et al. | |
| 7,468,005 | B2 | 12/2008 | Kouno et al. | |
| 7,470,200 | B2 | 12/2008 | Sanchez | |
| 7,476,161 | B2 | 1/2009 | Williams et al. | |
| 7,481,717 | B2 | 1/2009 | Knuth | |
| 7,488,261 | B2 | 2/2009 | Cackett et al. | |
| 7,494,424 | B2 | 2/2009 | Williams et al. | |
| 7,494,425 | B2 | 2/2009 | De Shiell et al. | |
| 7,614,964 | B2 | 11/2009 | Matsunaga | |
| 7,618,331 | B2 * | 11/2009 | Hirano | A63B 53/0466 473/329 |
| 7,704,162 | B2 | 4/2010 | Rice et al. | |
| 7,762,907 | B2 * | 7/2010 | Rice | A63B 53/0466 473/329 |
| 7,993,214 | B2 * | 8/2011 | Hirano | A63B 53/0466 473/329 |
| 8,012,041 | B2 * | 9/2011 | Gibbs | A63B 53/0466 473/329 |
| 8,038,546 | B2 | 10/2011 | Yokota | |
| 8,231,481 | B2 * | 7/2012 | Takechi | A63B 53/0466 473/342 |
| 8,272,975 | B2 | 9/2012 | Morin et al. | |
| 8,277,334 | B2 | 10/2012 | Meyer et al. | |
| 8,465,380 | B2 * | 6/2013 | Horacek | A63B 53/0466 473/329 |
| 8,696,489 | B2 * | 4/2014 | Gibbs | A63B 53/0466 473/329 |
| 8,715,107 | B2 * | 5/2014 | Brunski | A63B 53/0466 473/342 |
| 8,808,107 | B2 * | 8/2014 | Abe | A63B 53/0466 473/342 |
| 8,956,248 | B2 * | 2/2015 | DeMille | A63B 53/0466 473/342 |
| 2008/0161127 | A1 | 7/2008 | Yamamoto | |
| 2008/0167140 | A1 | 7/2008 | De Shiell et al. | |
| 2008/0182682 | A1 | 7/2008 | Rice et al. | |
| 2008/0248896 | A1 | 10/2008 | Hirano | |
| 2008/0287216 | A1 | 11/2008 | Nakamura | |
| 2008/0293515 | A1 | 11/2008 | Rice et al. | |
| 2008/0300068 | A1 | 12/2008 | Chao | |
| 2009/0005191 | A1 | 1/2009 | Lin | |
| 2009/0017937 | A1 | 1/2009 | Dyama | |
| 2009/0017938 | A1 | 1/2009 | Yokota | |
| 2009/0023511 | A1 | 1/2009 | Meyer et al. | |
| 2009/0036229 | A1 | 2/2009 | Oyama | |
| 2009/0048035 | A1 | 2/2009 | Stites et al. | |
| 2009/0069112 | A1 | 3/2009 | Gibbs et al. | |
| 2009/0069113 | A1 | 3/2009 | Nakano | |
| 2009/0075753 | A1 | 3/2009 | Williams et al. | |
| 2009/0075754 | A1 | 3/2009 | Horacek et al. | |
| 2009/0082134 | A1 | 3/2009 | Matsunaga et al. | |
| 2009/0088271 | A1 | 4/2009 | Beach et al. | |
| 2009/0088272 | A1 | 4/2009 | Foster et al. | |

FOREIGN PATENT DOCUMENTS

| | | | | |
|---|---|---|---|---|
| JP | 08280853 | A * | 10/1996 | |
| JP | H08-280853 | A | 10/1996 | |
| JP | 09192270 | A * | 7/1997 | A63B 53/0466 |
| JP | H09-192270 | A | 7/1997 | |
| JP | 10033723 | A * | 2/1998 | |
| JP | H10-33723 | A | 2/1998 | |
| JP | 10137372 | A * | 5/1998 | A63B 53/04 |
| JP | 11146934 | A * | 6/1999 | |
| JP | 11155982 | A * | 6/1999 | |
| JP | H11-146934 | A | 6/1999 | |
| JP | H11-155982 | A | 6/1999 | |
| JP | 11216204 | A * | 8/1999 | A63B 53/04 |
| JP | 11347158 | A * | 12/1999 | |
| JP | H11-347158 | A | 12/1999 | |
| JP | 2000229138 | A * | 8/2000 | |
| JP | 2002-000772 | A | 1/2002 | |
| JP | 2002000772 | A * | 1/2002 | A63B 53/0466 |
| JP | 2002-186692 | A | 7/2002 | |
| JP | 2002186692 | A * | 7/2002 | |
| JP | 2002239037 | A * | 8/2002 | A63B 53/0466 |
| JP | 2002-306646 | A | 10/2002 | |
| JP | 2002-315854 | A | 10/2002 | |
| JP | 2002306646 | A * | 10/2002 | |
| JP | 2002315854 | A * | 10/2002 | |
| JP | 2003154040 | A * | 5/2003 | |
| JP | 2003-245384 | A | 9/2003 | |
| JP | 2003245384 | A * | 9/2003 | A63B 53/0466 |

(56) References Cited

FOREIGN PATENT DOCUMENTS

| | | | | | |
|---|---|---|---|---|---|
| JP | 2004-313354 | A | | 11/2004 | |
| JP | 2004313354 | A | * | 11/2004 | |
| JP | 2005-124745 | A | | 5/2005 | |
| JP | 2005124745 | A | * | 5/2005 | ..... A63B 53/0466 |
| JP | 2005-168665 | A | | 6/2005 | |
| JP | 2005143601 | A | * | 6/2005 | ..... A63B 53/0466 |
| JP | 2005-177170 | A | | 7/2005 | |
| JP | 2005177170 | A | * | 7/2005 | |
| JP | 2008036050 | A | * | 2/2008 | |
| JP | 2008253564 | A | * | 10/2008 | ..... A63B 53/0466 |
| JP | 2010082215 | A | * | 4/2010 | |
| JP | 2011072368 | A | * | 4/2011 | |

* cited by examiner

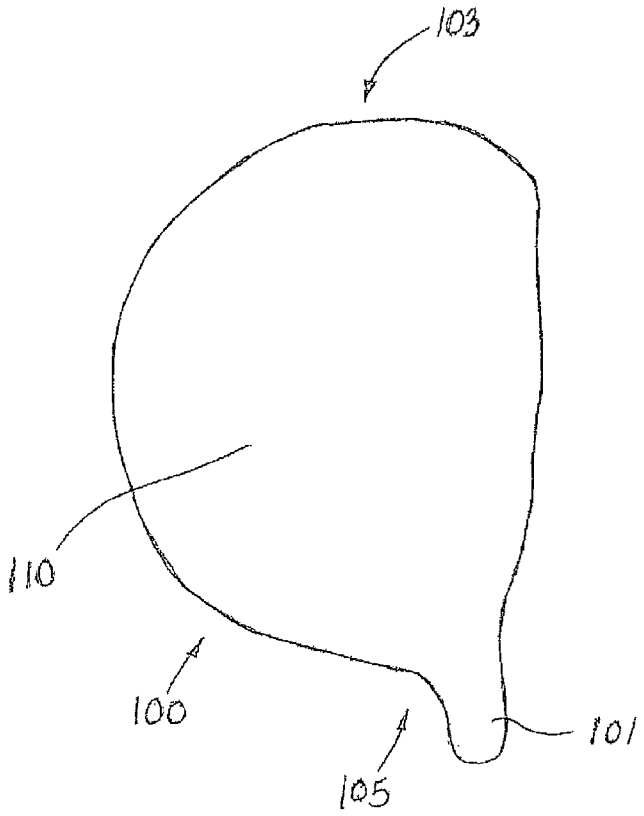
FIG. 1A1

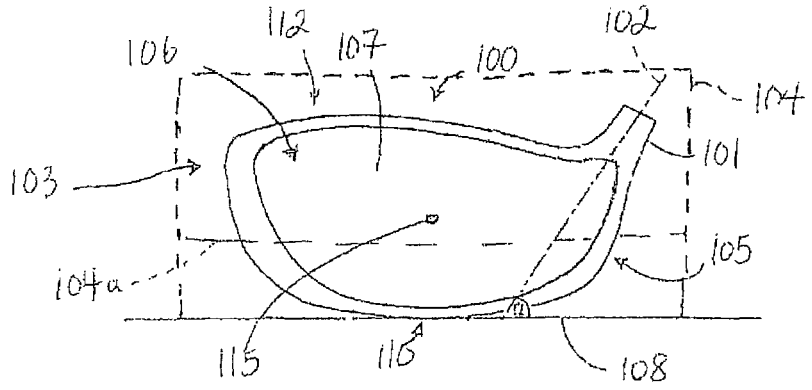
FIG. 1A2

GOLF CLUB HEAD

This is a Continuation of application Ser. No. 14/222,206 filed Mar. 21, 2014, which is a Continuation of application Ser. No. 12/900,899 filed Oct. 8, 2010, which claims the benefit of Provisional Application No. 61/258,011, filed on Nov. 4, 2009. The prior applications, including the specifications, drawings and abstract are incorporated herein by reference in their entirety.

BACKGROUND

It is generally known to those skilled in the art that non-uniform face-thickness reduction of a golf club head at selected locations increase the amount of available discretionary mass, which is the difference between the target mass of the club head and the minimum mass required to form a head having the requisite structural integrity. The additional discretionary mass may then be beneficially distributed throughout the club head to lower the center of gravity, thus creating optimal ball-launch conditions, and to increase the moment of inertia, improving club-head stability during off-center ball impacts. Moreover, variable club-face thickness may advantageously limit the reduction of average face compliance of the club head.

To achieve the benefits described above, manufacturers commonly produce club heads with faces having pronounced thickness variations. However, since club faces typically comprise exotic materials, such as high-performance titanium alloys, and because face contouring requires intricate machining operations, a substantial reduction in localized face thickness is generally associated with increased material and processing costs.

SUMMARY

The present invention, in one or more aspects thereof, may advantageously comprise a golf club head having a strike-face wall that delivers advanced performance, desired durability, and a favorable geometry that promotes greater manufacturing efficiency and lower production cost.

In one example, a golf club head, according to one or more aspects of the present invention, may include a face portion having a top inner boundary and a bottom inner boundary comprising a toe portion and a heel portion. The face portion may further include a continuous uniform-thickness region and a variable-thickness region. The continuous uniform-thickness region may adjoin the top inner boundary, the bottom-inner-boundary toe portion, and the bottom-inner-boundary heel portion. The variable-thickness region may adjoin the uniform-thickness region and the majority of the bottom inner boundary.

In another example, a strike-face wall for a golf club head, according to one or more aspects of the present invention, may include a top inner boundary and a bottom inner boundary having a toe portion and a heel portion. The strike-face wall may further include a uniform-thickness region, adjoining the bottom inner boundary, and a variable-thickness region, adjoining the majority of the top inner boundary.

In another example, a strike-face wall for a golf club head, according to one or more aspects of the present invention, may include a top inner boundary and a bottom inner boundary having a toe portion and a heel portion. The strike-face wall may further include a uniform-thickness region, adjoining the top inner boundary, and a continuous variable-thickness region adjoining the uniform-thickness region and the majority of the bottom inner boundary.

In yet another example, a strike-face wall for a golf club head, according to one or more aspects of the present invention, may include a top inner boundary and a bottom inner boundary having a toe portion and a heel portion. The strike-face wall may further include a first uniform-thickness region, adjoining the top inner boundary, a second uniform-thickness region, adjoining the bottom inner boundary, and a continuous variable-thickness region adjoining the toe portion, the heel portion, the first uniform-thickness region, and the second uniform-thickness region.

These and other features and advantages of the golf club head according to the invention in its various aspects, as provided by one or more of the examples described in detail below, will become apparent after consideration of the ensuing description, the accompanying drawings, and the appended claims. The accompanying drawings are for illustrative purposes only and are not intended to limit the scope of the present invention.

BRIEF DESCRIPTION OF THE DRAWINGS

Exemplary implementations of the present invention will now be described with reference to the accompanying drawings, wherein:

FIG. 1A1 is a bottom plan view of the golf club head of FIG. 1.

FIG. 1A2 is a front elevational view of the golf club head of FIG. 1.

FIG. 1I is a perspective view of the golf club head of FIG. 1.

FIG. 2 is an exploded view of an exemplary golf club head according to one or more aspects of the present invention.

DESCRIPTION

Figure 1:
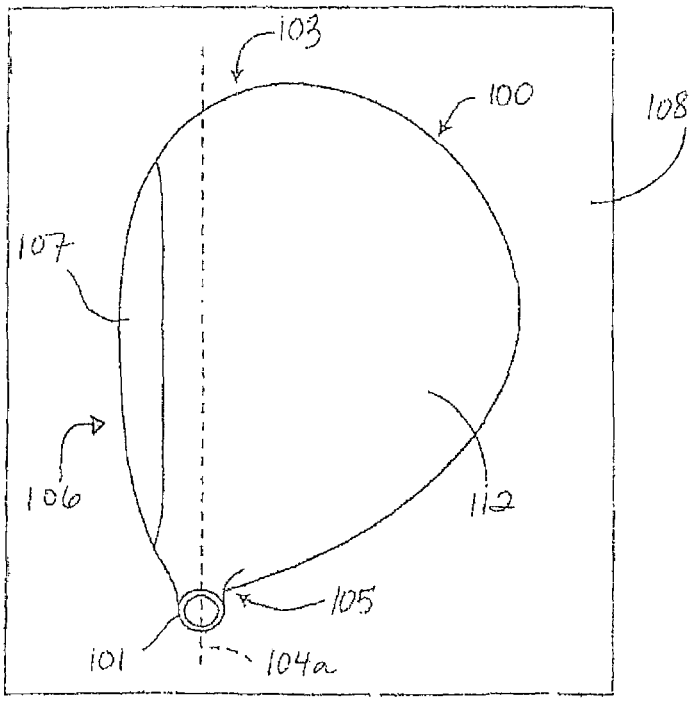
FIG. 1 is a top plan view of an exemplary golf club head according to one or more aspects of the present invention.
Figure 1B:
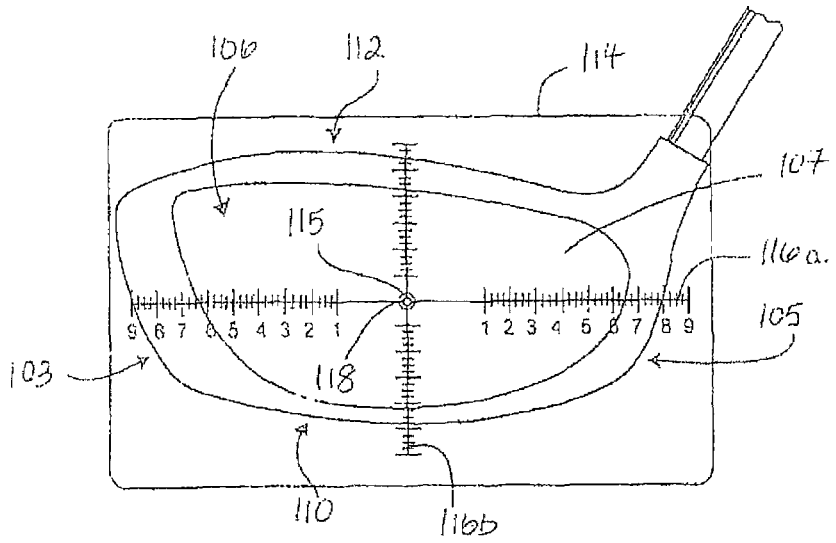
FIG. 1B is a front elevational view of the golf club head of FIG. 1, with a template applied thereto.
Figure 1C:
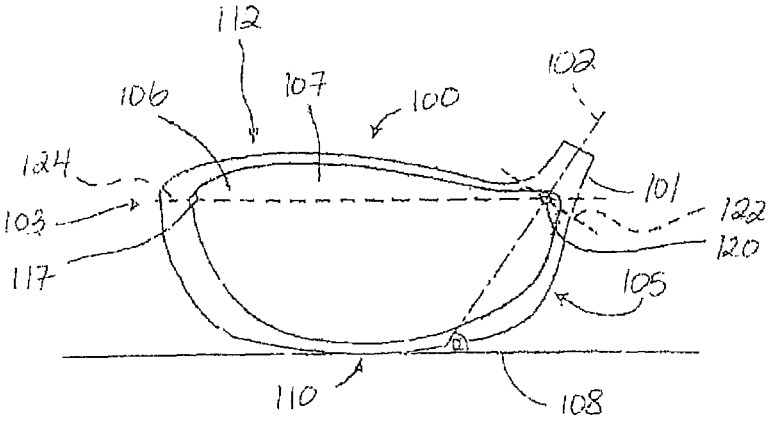
FIG. 1C is a front elevational view of the golf club head of FIG. 1.
Figure 1D:
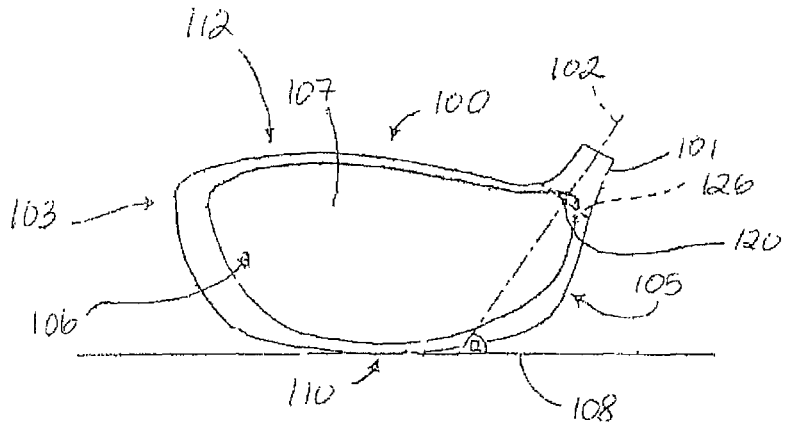
FIG. 1D is front elevational view of the golf club head of FIG. 1.
Figure 1E:
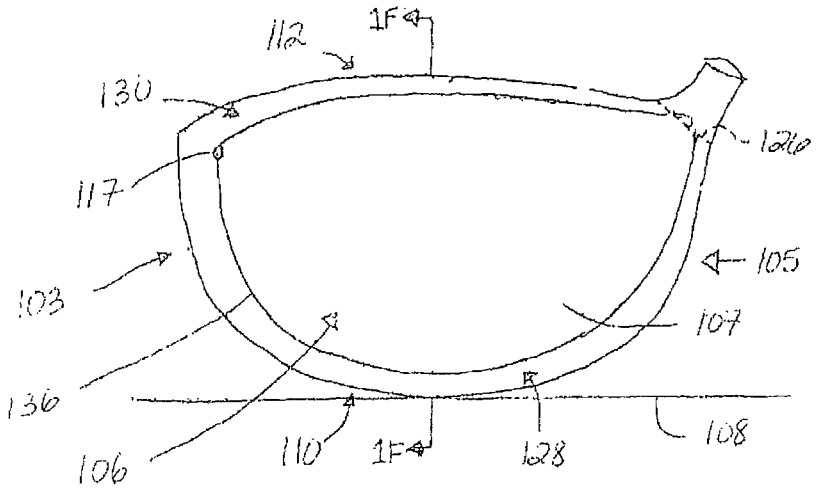
FIG. 1E is a front elevational view of the golf club head of FIG. 1.
Figure 1F:
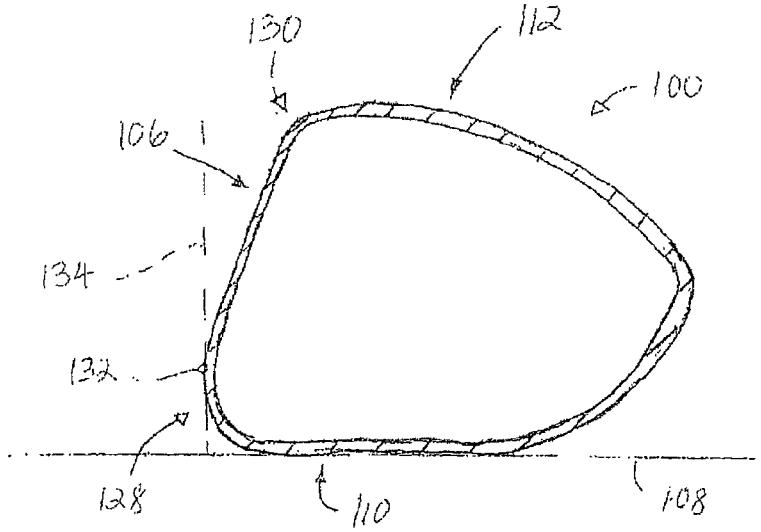
FIG. 1F is a cross-sectional view of the golf club head of FIG. 1E taken in the direction of the lines 1F-1F.
Figure 1G:
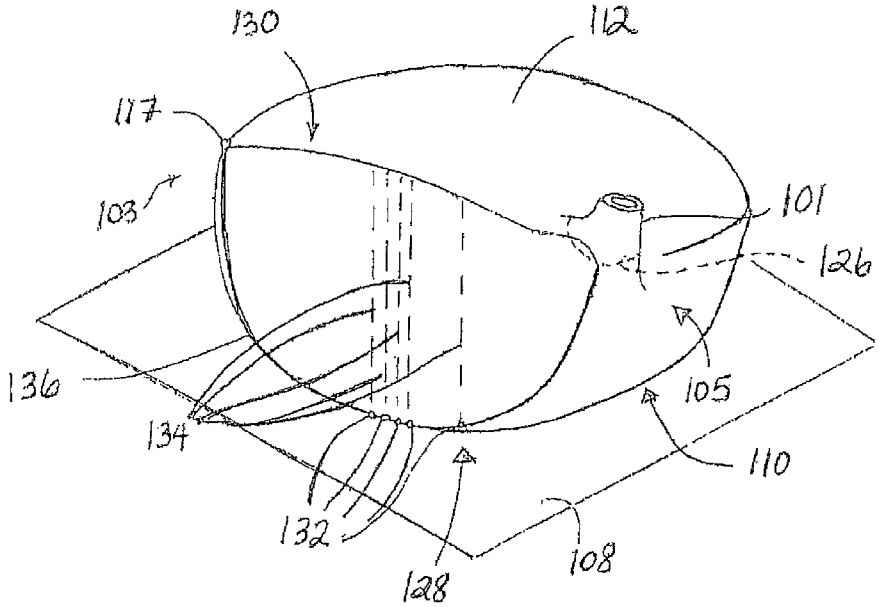
FIG. 1G is a perspective view of the golf club head of FIG. 1.
Figure 1H:
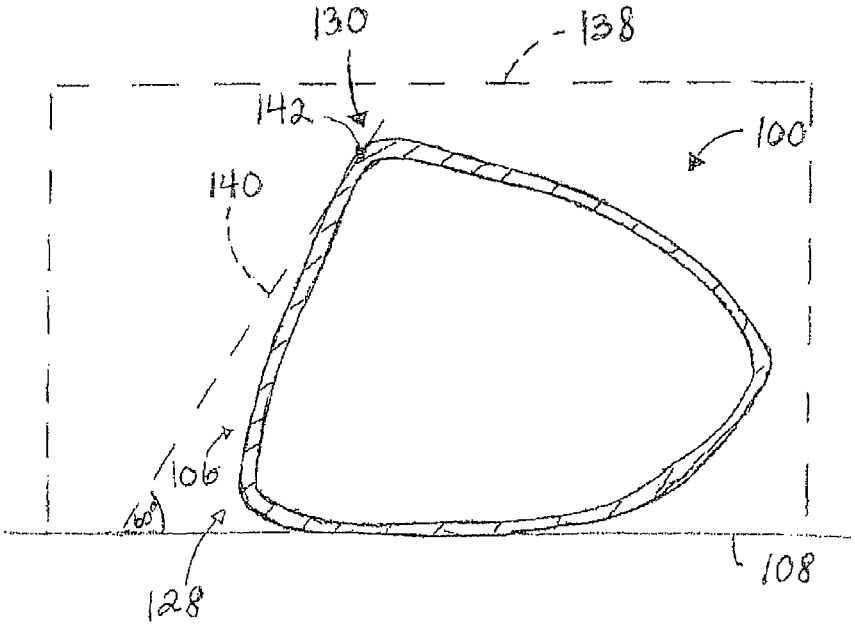
FIG. 1H is a cross-sectional view of the golf club head of FIG. 1E taken in the direction of the lines 1F-IF.
Figure 1J:
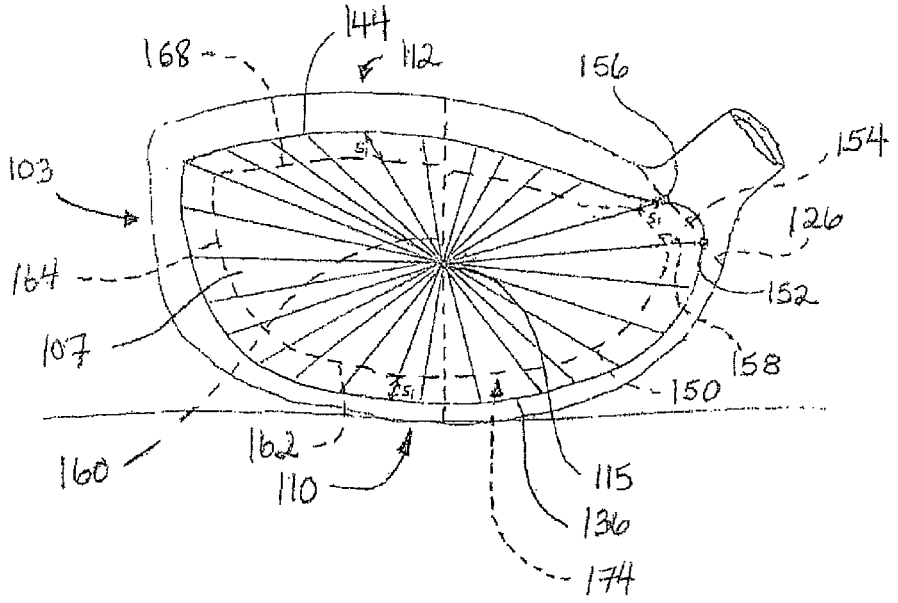
FIG. 1J is a front elevational view of the golf club head of FIG. 1.
Figure 1K:
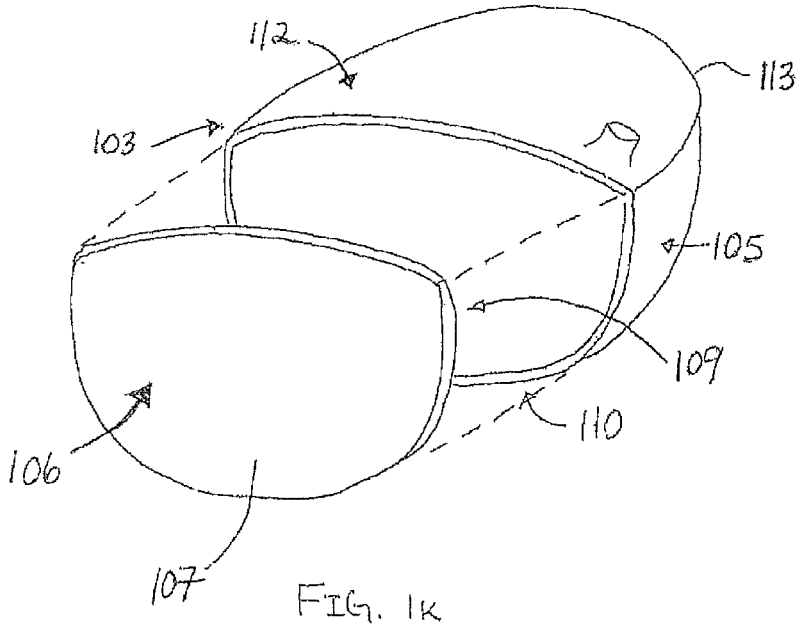
FIG. 1K is an exploded view of the golf club head of FIG. 1.

For clarity, the definitions used herein are interpreted with reference to one or more aspects of the invention characterized in relation to FIGS. 1-1K of the drawings. However, those skilled in the art will appreciate that such definitions also apply to same or similar aspects of the invention described throughout the specification in connection with the remaining drawing figures.

Figure 2:
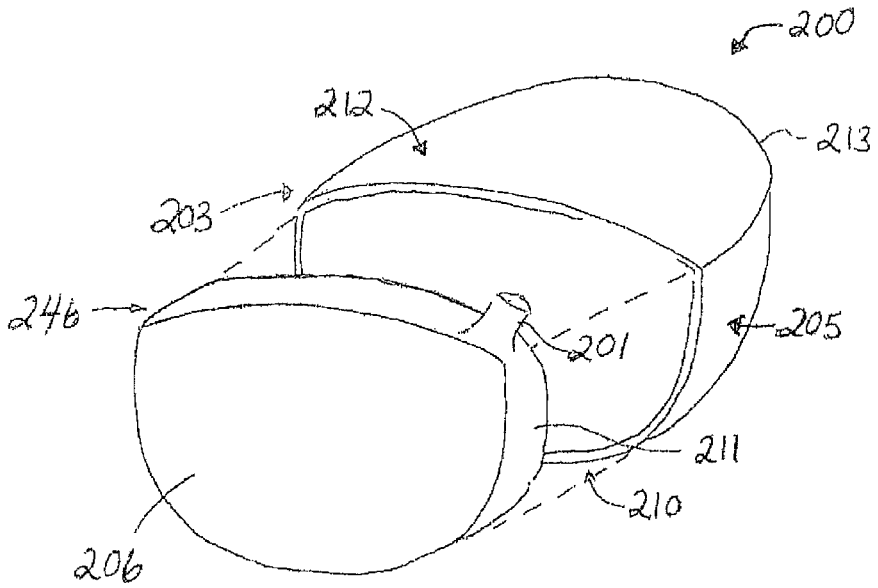

As illustrated in FIGS. 1 and 1A2, a club head 100 may comprise a hosel 101, a toe 103, a heel 105, a front portion 106 having a front surface 107, a bottom portion 110, and a top portion 112.

Referring to FIGS. 1 and 1A2, the hosel 101 has a central axis or centerline 102. "Reference position", as used herein, denotes a position of the club head where the hosel centerline 102 is oriented at a lie angle $\alpha$ of 60° with respect to a horizontal ground plane 108 and lies in an imaginary vertical hosel plane 104, which contains an imaginary horizontal line 104*a*, generally parallel to the front surface 107. Unless otherwise indicated, all parameters herein are specified with the club head in the reference position.

As used herein, "front portion", e.g., the front portion 106, also referred to as a strike-face wall, denotes a portion of a golf club head at least partially delimited by a generally planar front surface 107, suitable for striking a golf ball, and a rear surface 109 (FIG. 1K). Those skilled in the art will appreciate that even though the front surface 107 is referred to as generally planar, in one or more aspects of the invention it may possess bulge and roll specifications customary in a wood-type club. Alternatively, the front surface 107 may be essentially flat, as in an iron-type club.

Referring to FIGS. 1A2 and 1B, "face center", e.g., a face center 115, as used herein, is located using a template 114, having a coordinate system with a heel-toe axis 116*a* orthogonal to a top-bottom axis 116*b*. An aperture 118 is disposed at the origin of the coordinate system and the axes 116*a*, 116*b* are graduated into evenly spaced increments. The template 114 may be made of a flexible material, e.g., a transparent polymer.

The location of the face center 115 is determined as follows. The template 114 is initially applied to the front surface 107 so that the aperture 118 is approximately in the middle of the front surface 107 and the heel-toe axis 116*a* is generally parallel to the hosel plane 104. The template is then translated in the heel-toe direction along the front surface 107 until the heel and the toe measurements along the axis 116*a* at the opposite edges of the front surface 107 have the same absolute value. Once the template 114 is centered with respect to the front surface 107 in the heel-toe direction, the template is translated in the top-bottom direction along the front surface until the top and the bottom measurements along the axis 116*b* at the opposite edges of the front surface have the same absolute value. The above sequence is repeated until the absolute value of the heel measurement along axis 116*a* is equal to that of the toe measurement and the absolute value of the bottom measurement along axis 116*b* is equal to that of the top measurement. A point is then marked on the front surface through the aperture 118 to designate the face center 115.

A locating template, such as the template 114, is referenced in the United States Golf Association's Procedure for Measuring the Flexibility of a Golf Clubhead (Revision 2.0, Mar. 25, 2005) and is available from the USGA.

Referring to FIG. 1C, "outer toe point", e.g., an outer toe point 117, as used herein, denotes the furthest laterally projecting point of the front surface 107 proximate the toe 103.

As shown in FIG. 1C, an imaginary horizontal plane 124, passing through the outer toe point 117, will intersect the hosel centerline 102 at point 120. "Hosel ", e.g., the hosel 101, as used herein, denotes a portion of the club head delimited from the rest of the head by an imaginary plane 122 normal to the hosel centerline 102 and containing point 120.

Referring to FIGS. 1C and 1D, "intermediate outer boundary", e.g., an intermediate outer boundary 126, as used herein, denotes the intersection between the outer surface of the club head and the plane 122.

Referring to FIG 1, "top portion", e.g., the top portion 112, as used herein, denotes the portion of the club head, excluding the front portion 106 and the hosel 101, visible in a top plan view with the club head in the reference position.

Referring to FIG. 1A1, "bottom portion", e.g., the bottom portion 110, as used herein, denotes the portion of the club head, excluding the hosel 101, visible in a bottom plan view with the club head in the reference position.

Referring to FIG. 1E and 1F, "front-top junction", e.g., a front-top junction 130, as used herein, denotes a boundary region between the front portion 106 and the top portion 112.

Referring to FIG. 1E and 1F, "front-bottom junction", e.g., a face-bottom junction 128, as used herein, denotes a boundary region between the front portion 106 and the bottom portion 110.

Referring to FIGS. 1E-1G, "bottom outer boundary", e.g., a bottom outer boundary 136, as used herein, denotes an at least partially curvilinear path that originates at the outer toe point 117, terminates at the intermediate outer boundary 126, and comprises a plurality of locations along the front-bottom junction 128, wherein such plurality of locations is characterized by points of tangency 132 between corresponding imaginary vertical lines 134 and the front-bottom junction 128, with the club head 100 in the reference position.

Referring to FIGS. 1H-1J , "top outer boundary", e.g., a top outer boundary 144, as used herein, denotes an at least partially curvilinear path that originates at the outer toe point 117, terminates at the intermediate outer boundary 126, and comprises a plurality of locations along the front-top junction 130, wherein such plurality of locations is characterized by points of tangency 142 between corresponding imaginary lines 140, each oriented at an angle of 60° relative to horizontal, and the front-top junction 130, with the club head 100 in the reference position. Each imaginary line 140 is located in an imaginary vertical plane 138, perpendicular to the hosel plane 104 (FIG. 1A2).

Referring to FIG. 1J, "intermediate-outer-boundary face portion", e.g., an intermediate outer-boundary-face portion 154, as used herein, denotes the portion of the intermediate inner boundary 126 between a first outer heel point 156, defined as the point of intersection between the intermediate outer boundary 126 and the top outer boundary 144, and the second outer heel point 152, defined as the point of intersection between the intermediate outer boundary 126 and the bottom outer boundary 136.

"Inner boundary", e.g., an inner boundary 174, as used herein, includes a top inner boundary 168, a bottom inner boundary 162, and an intermediate inner boundary 158. Each point of the top inner boundary 168 is displaced, along the front surface 107 in the direction of the face center 115, relative to a corresponding point of the top outer boundary 144 by a constant offset $s_1$, preferably between about 0.5 mm and about 15 mm and, more preferably, between about 1 mm and about 8 mm. Each point of the bottom inner boundary 162 is displaced, along the front surface 107 in the direction of the face center 115, relative to a corresponding point of the bottom outer boundary 136 by the constant offset $s_1$. Each point of the intermediate inner boundary 158 is displaced, along the front surface 107 in the direction of the face center 115, relative to a corresponding point of the face portion of the intermediate outer boundary 154 by the constant offset $s_1$. Those skilled in the art will appreciate that, for ease of reference, the horizontal projections of the top inner boundary 168, the intermediate inner boundary 158, the bottom inner boundary 162, and the face center 115 on to the rear surface 109 (FIG. 1K), with the strike-face wall 106 generally vertically oriented, will be referred to using the same nomenclature and reference numerals.

Referring again to FIG. 1J, "bottom-inner-boundary toe portion", e.g., a bottom-inner-boundary toe portion 164, as used herein, denotes the portion of the bottom inner boundary 162 delimited by the imaginary vertical plane 160, perpendicular to the hosel plane 104 (FIG. 1A2) and containing the face center 115, and the top inner boundary 168.

Referring again to FIG. 1J, "bottom-inner-boundary heel portion", e.g., a bottom-inner-boundary heel portion 150, as used herein, denotes the portion of the bottom inner boundary 162 delimited by the imaginary vertical plane 160 and the intermediate inner boundary 158.

Figure 3:
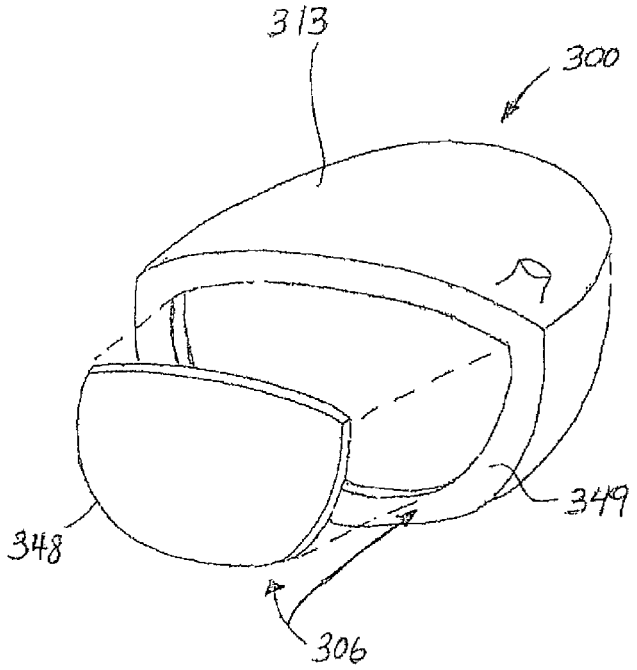
FIG. 3 is an exploded view of an exemplary golf club head according to one or more aspects of the present invention.

Referring to FIG. 1K, the front portion 106 may be coupled to a club head body 113, e.g., by mechanical interlocking, welding, brazing, or adhesive bonding. The head body 113 and/or the front portion 106 may comprise a metallic and/or non-metallic material, e.g., stainless steel, titanium, or fiber-reinforced plastic. Preferably, the front portion 106 is formed from a different material than the bead body 113. In other examples, the front portion 106 and the head body 113 may comprise the same material. As shown in FIG. 2, a club head 200 may include a cup-face portion 246, comprising a front portion 206 with an annular portion 211 extending therefrom. The annular portion 211 may be integral with the front portion 206 and may be coupled to a club head body 213 via one of the joining methods described above. In another aspect of the present invention, depicted in FIG. 3, a club head 300 may comprise a front portion 306, which includes a face insert 348 and a peripheral portion 349, integrally formed with a club head body 313. The face insert 348 and the peripheral portion 349 may comprise the same or different materials. The face insert 348 may be coupled to the peripheral portion 349 via one of the joining methods discussed above.

Figure 4:
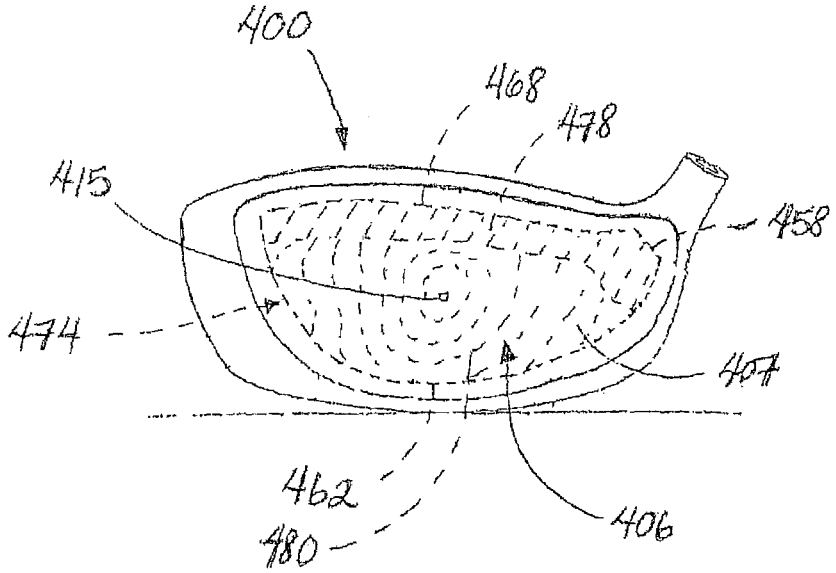
FIG. 4 is a front elevational view of an exemplary golf club head according to one or more aspects of the present invention.
Figure 4A:
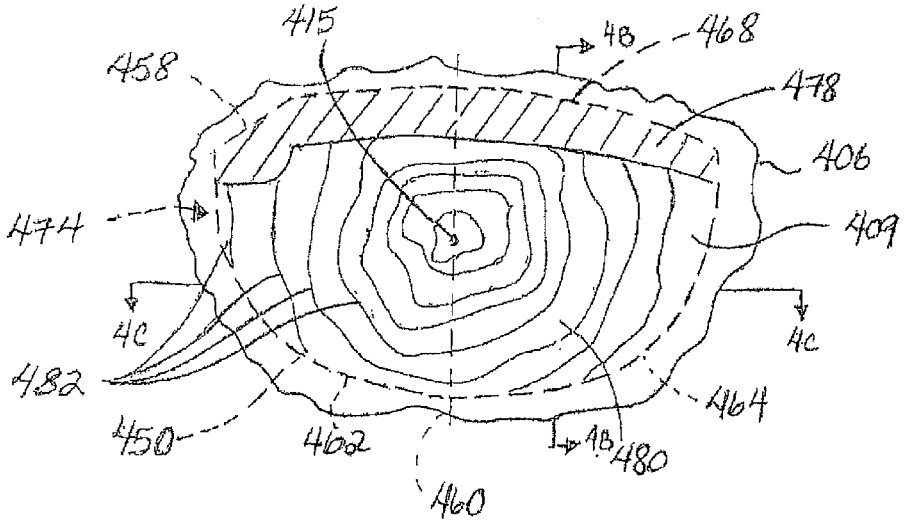
FIG. 4A is a rear elevational schematic view of a portion of a strike-face wall of the golf club head of FIG. 4.

Referring to FIGS. 4 and 4A, a golf club head 400, according to one or more aspects of the present invention, includes a front portion or strike-face wall 406 having a front surface 407 and a rear surface 409, which comprises a top inner boundary 468, an intermediate inner boundary 458, and a bottom inner boundary 462, together defining an inner boundary 474. As shown in FIG. 4A, the bottom inner boundary 462 may include a bottom-inner-boundary heel portion 450 and a bottom-inner-boundary toe portion 464, located on opposite sides of an imaginary vertical plane 460. The thickness of the front portion 406 at any point on the front surface 407 is characterized as the horizontal distance between said point and the rear surface 409, with the front portion 406 being generally vertically oriented. Accordingly, the front portion 406 may include a uniform-thickness region 478 adjoining at least a portion of the top inner boundary 468, a portion of the bottom-inner-boundary toe portion 464, and a portion of the bottom-inner-boundary heel portion 450. The front portion 406 may also include a single continuous variable-thickness region 480 that adjoins both the uniform-thickness region 478, via a gradual or an immediate transition, and the majority of the bottom inner boundary 462. The presence of the variable-thickness region 480 increases the average compliance of the strike-face wall 406. During a golf shot, the increased compliance of the strike wall improves energy transfer from the club head 400 to the golf ball, thus increasing the initial ball velocity and travel distance. The strike-face wail 406 may be formed by, e.g., a casting, machining, and/or a forging process such as stamping.

The variable-thickness region 480 is characterized by a change in thickness between successive contour lines 482 (See FIG. 4A), each representing a constant-thickness region of the strike-face wall 406. The thickness dimension of the region 480 may change at a linear or non-linear rate. Preferably, the region 480 has a thickness dimension that ranges between about 2 mm and about 5 mm, more preferably between about 2.2 mm and about 4 mm, and most preferably between about 2.5 mm and about 3.8 mm. The uniform-thickness region 478 has a manufacturing thickness tolerance between about 0.01 mm and about 0.2 mm and encompasses at least about 5% of the rear surface area of the strike-face wall 406 within the inner boundary 474. The thickness dimension of the uniform-thickness region may be less than about 4 mm and more preferably less than about 3 mm.

Figure 4B:
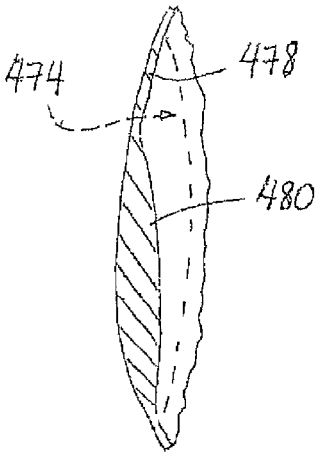
FIG. 4B is a cross-sectional view of the portion of the strike-face wall of FIG. 4A taken in the direction of the lines 4B-4B.
Figure 4C:
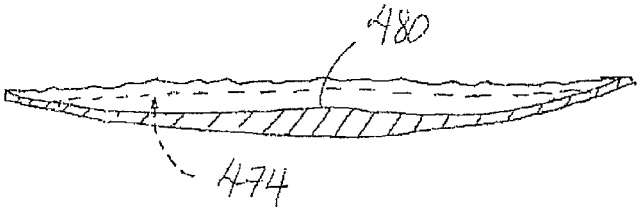
FIG. 4C is a cross-sectional view of the portion of the strike-face wall of FIG. 4A taken in the direction of the lines 4C-4C.
Figure 5:
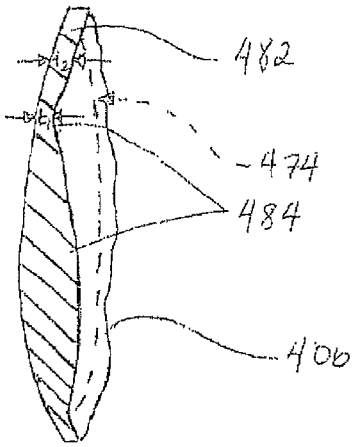
FIG. 5 is a cross-sectional view of a portion of an exemplary strike-face wall according to one or more aspects of the present invention.

As shown in FIGS. 4B and 4C, the variable-thickness region 480 may gradually taper from a maximum thickness dimension, located generally proximate a face center 415 (FIG. 4), toward the bottom inner boundary 462 and the uniform-thickness region 478. Accordingly, the strike-face wall 406 generally has the smallest thickness dimension within the confines of the uniform-thickness region 478. In another example, shown in FIG. 5, the strike-face wall 406, according to one or more aspects of the present invention, may have the smallest thickness dimension $t_1$ located in a variable-thickness region 484. Accordingly, a uniform-thickness region 482 may have a thickness dimension $t_2$ that is equal to or greater than the smallest thickness dimension $t_1$.

Figure 6:
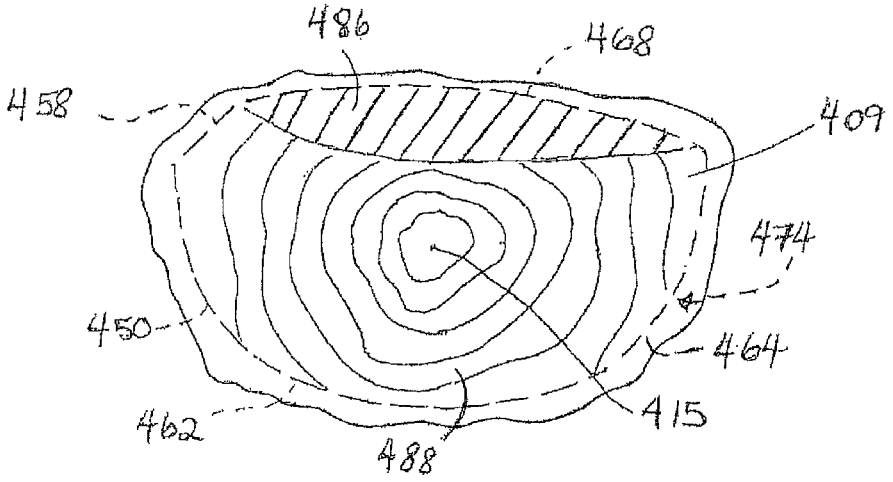
FIG. 6 is a rear elevational schematic view of a portion of an exemplary strike-face wall according to one or more aspects of the present invention.

As shown in FIG. 6, the strike-face wall of the golf club head 400, according to one or more aspects of the present invention, may alternatively have a uniform-thickness region 486 and a variable-thickness region 488. The uniform-thickness region 486 may adjoin at least a portion of the top inner boundary 468 and, at most, a single point of the bottom-inner-boundary toe portion 464 and/or a single point of the intermediate inner boundary 458. Preferably, the uniform-thickness region 486 may adjoin the entire top inner boundary 468. The variable-thickness region 488 may adjoin the uniform-thickness region 486, the majority of the bottom inner boundary 462, and the majority of the intermediate inner boundary 458. In another example, the variable-thickness region 488 may adjoin the entire bottom inner boundary 462.

Figure 7:
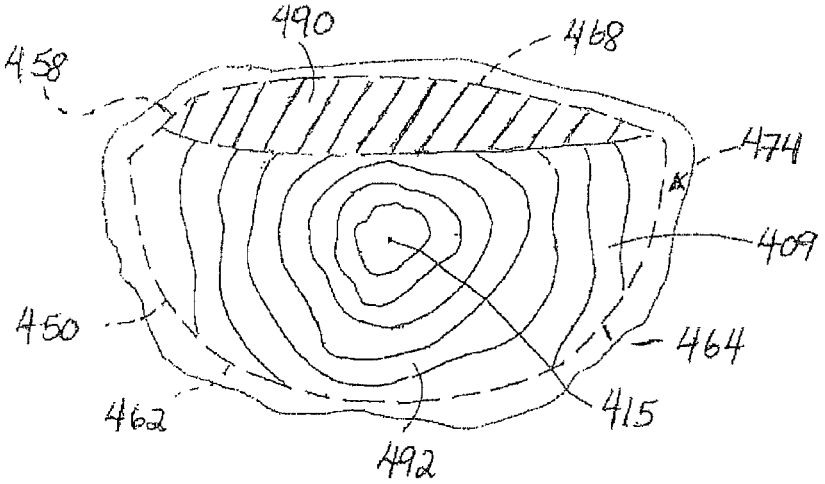
FIG. 7 is a rear elevational schematic view of a portion of an exemplary strike-face wall according to one or more aspects of the present invention.

As shown in FIG. 7, the strike-face wall of the golf club head 400, according to one or more aspects of the present invention, may alternatively have a uniform-thickness region 490 and a variable-thickness region 492. The uniform-thickness region 490 may adjoin at least a portion of the top inner boundary 468, a portion of the intermediate inner boundary 458, and, at most, a single point of the bottom-inner-boundary toe portion 464. Preferably, the uniform-thickness region 490 may adjoin the entire top inner boundary 468 and a majority of the intermediate inner boundary 458. The variable-thickness region 492 may adjoin the uniform-thickness region 490, a majority of the bottom inner boundary 462, and a portion of the intermediate inner boundary 458. In another example, the variable-thickness region 492 may adjoin the entire bottom inner boundary 462, a majority of the intermediate inner boundary 458, and a portion of the top inner boundary 468.

Figure 8:
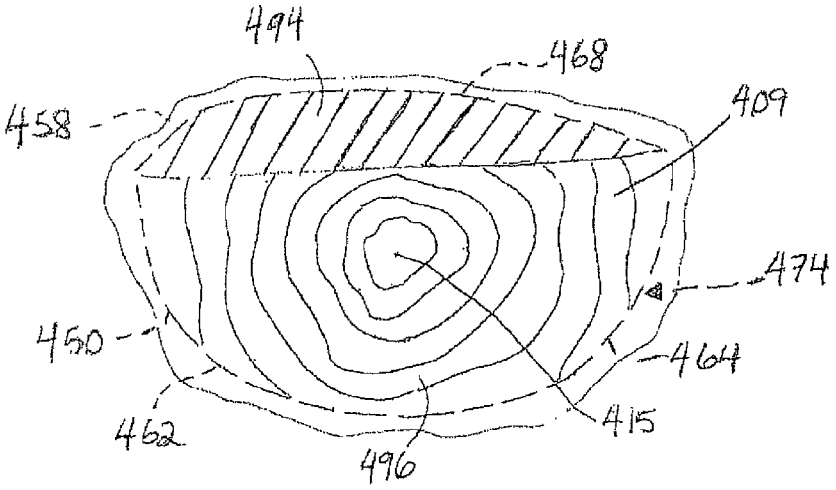
FIG. 8 is a rear elevational schematic view of a portion of an exemplary strike-face wall according to one or more aspects of the present invention.

Referring to FIG. 8, the strike-face wall of the golf club head 400, according to one or more aspects of the present invention, may alternatively have a uniform-thickness region 494 and a variable-thickness region 496. The uniform-thickness region 494 may adjoin at least a portion of the top inner boundary 468 and the intermediate inner boundary 458, as well as, at most, a single point of the bottom-inner-boundary toe portion 464 and/or the bottom-inner-boundary heel portion 450. Preferably, the uniform-thickness region 494 adjoins the entire top inner boundary 468 and the entire intermediate inner boundary 458. The variable-thickness region 496 may adjoin the uniform-thickness region 494 and a majority of the bottom inner boundary 462. In another example, the variable-thickness region 496 may adjoin the entire bottom inner boundary 462, as well as a portion of the top inner boundary 468.

Figure 9:
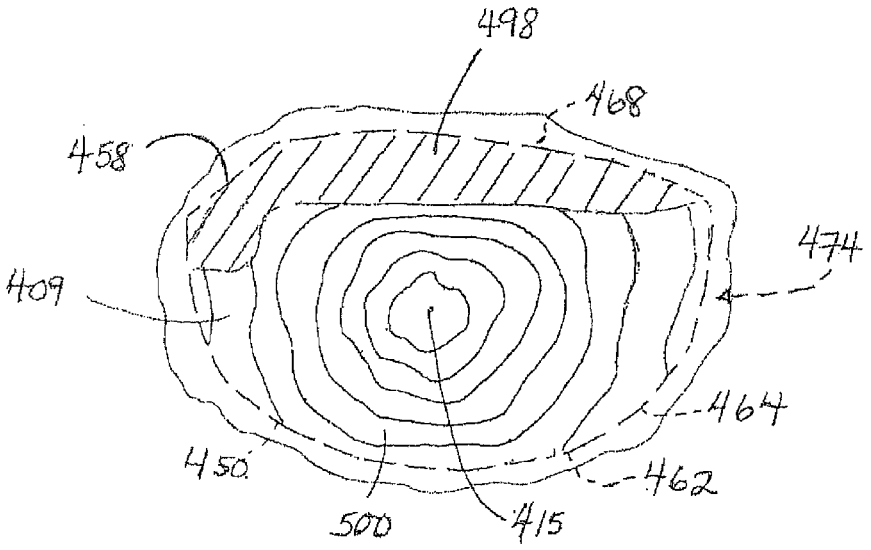
FIG. 9 is a rear elevational schematic view of a portion of an exemplary strike-face wall according to one or more aspects of the present invention.

As shown in FIG. 9, the strike-face wall of the golf club head 400, according to one or more aspects of the present invention, may alternatively have a uniform-thickness region 498 and a variable-thickness region 500. The uniform-thickness region 498 may adjoin at least a portion of the top inner boundary 468, the intermediate inner boundary 458, and the bottom-inner-boundary heel portion 450, as well as, at most, a single point of the bottom-inner-boundary toe portion 464. Preferably, the uniform-thickness region 498 adjoins the entire top inner boundary 468 and the entire intermediate inner boundary 458. The variable-thickness region 500 may adjoin the uniform-thickness region 498, a majority of the bottom inner boundary 462, and a portion of the top inner boundary 468.

Figure 10:
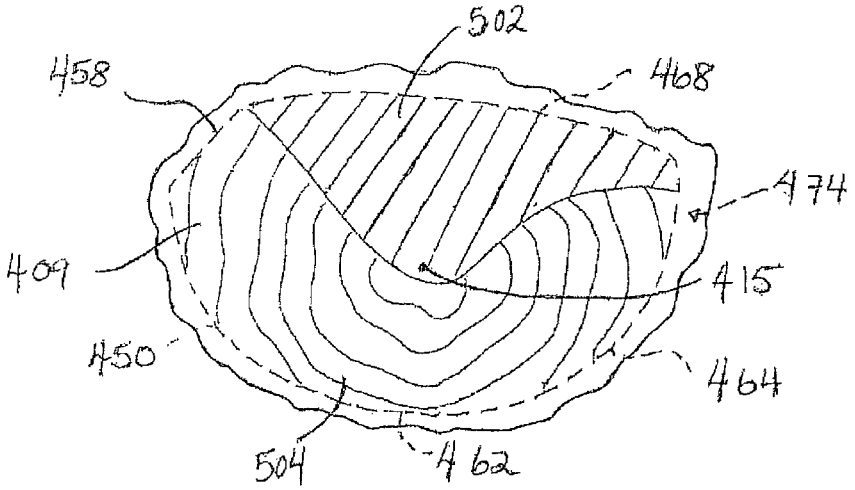
FIG. 10 is a rear elevational schematic view of a portion of an exemplary strike-face wall according to one or more aspects of the present invention.
Figure 11:
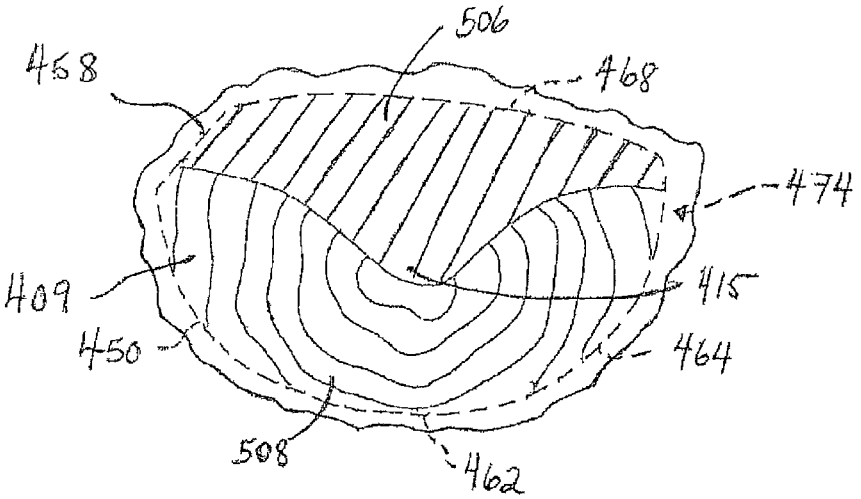

Referring to FIG. 10, the strike-face wall of the golf club head 400, according to one or more aspects of the present invention, may alternatively have a uniform-thickness region 502 and a variable-thickness region 504. The uniform-thickness region 502 may adjoin at least a portion of the top inner boundary 468, a portion of the bottom-inner-boundary toe portion 464, and, at most, a single point of the intermediate inner boundary 458. Preferably, the face,center 415 is located in the uniform-thickness region 478. Accordingly, the smallest thickness dimension may be located proximate the face center 415. The variable-thickness region 504 may adjoin the uniform-thickness region 502, a majority of the bottom inner boundary 462, and the entire intermediate inner boundary 458. In one example, the variable-thickness region 504 may encompass at least about 60% of the rear surface area of the strike-face wall 406 within the inner boundary 474. In other examples, the variable-thickness region 504 may preferably encompass at least about 50% of the rear surface area of the strike-face wall 406 within the inner boundary 474 and may more preferably encompass at least about 40% of the rear surface area of the strike-face wall 406 within the inner boundary 474.

Figure 11:
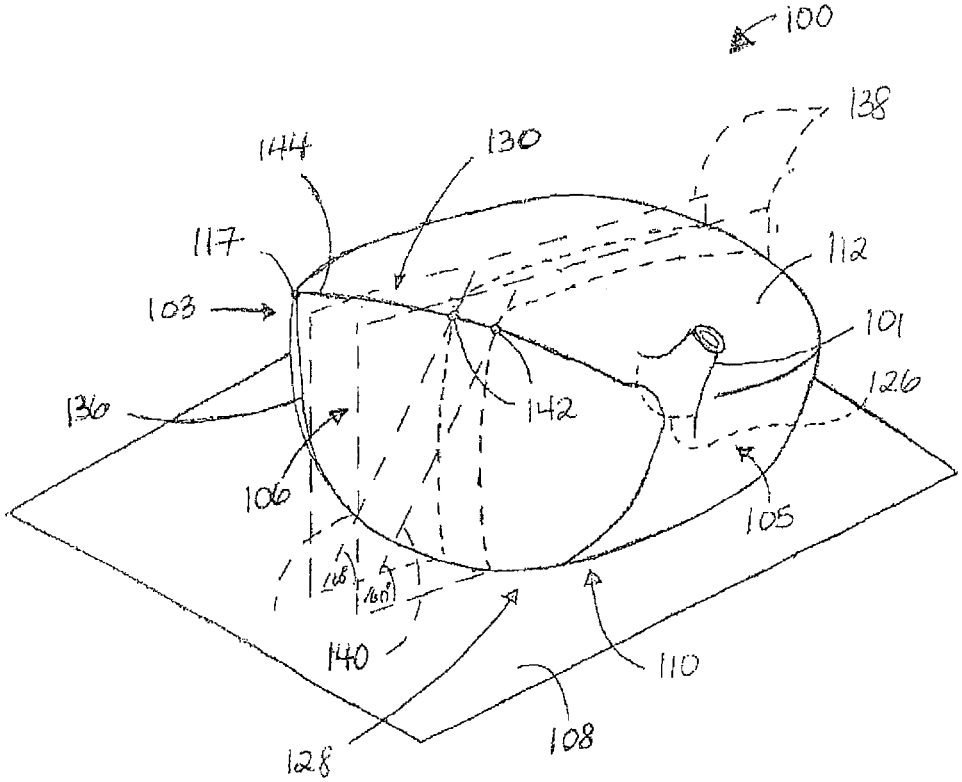
FIG. 11 is a rear elevational schematic view of a portion of an exemplary strike-face wall according to one or more aspects of the present invention.

As shown in FIG. 11, the strike-face wall of the golf club head 400; according to one or more aspects of the present invention, may alternatively have a uniform-thickness region 506 and a variable-thickness region 508. The uniform-thickness region 506 may adjoin at least a portion of the top inner boundary 468, the intermediate inner boundary 458, and the bottom-inner-boundary toe portion 464. Preferably, the uniform-thickness region 506 may encompass at least about 20% of the rear surface area of the strike-face wall within the inner boundary 474. More preferably, the uniform-thickness region 506 may encompass at least about 30% of the rear surface area of the strike-face wall within the inner boundary 474. The face center 415 may be located in the uniform-thickness region 506. The variable-thickness region 508 may adjoin the uniform-thickness region 506, a majority of the bottom inner boundary 462, and a portion of the intermediate inner boundary 458. In one example, the variable-thickness region 508 may be dissociated from the top inner boundary 468.

Figure 12:
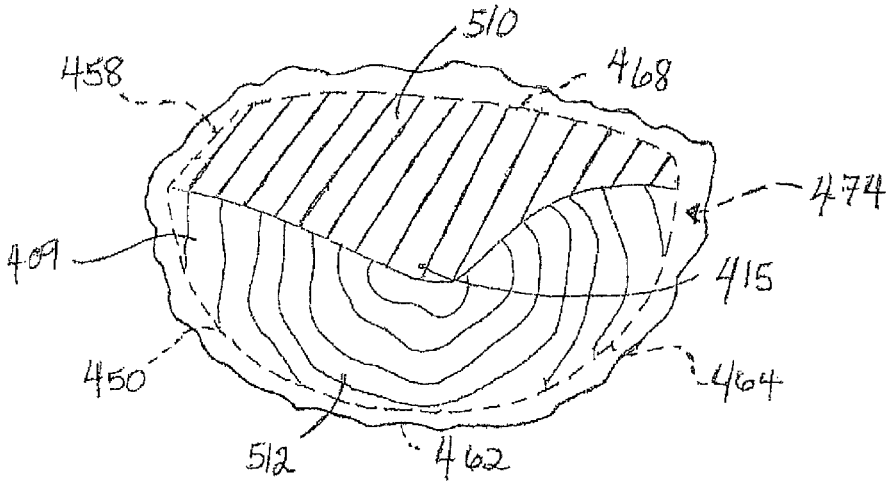
FIG. 12 is a rear elevational schematic view of a portion of an exemplary strike-face wall according to one or more aspects of the present invention.

As shown in FIG. 12, the strike-face wall of the golf club head 400, according to one or more aspects of the present invention, may alternatively have a uniform-thickness region 510 and a variable-thickness region 512. The uniform-thickness region 510 may adjoin at least a portion of the top inner boundary 468, the intermediate inner boundary 458, the bottom-inner-boundary toe portion 464, and the bottom-inner-boundary heel portion 450. Preferably, the uniform-thickness region 510 may adjoin the entire top inner boundary 468 and the entire intermediate inner boundary 458. The face center 415 may be located in the uniform-thickness region 510. The variable-thickness region 512 may adjoin the uniform-thickness region 510 and a majority of the bottom inner boundary 462.

Figure 13:
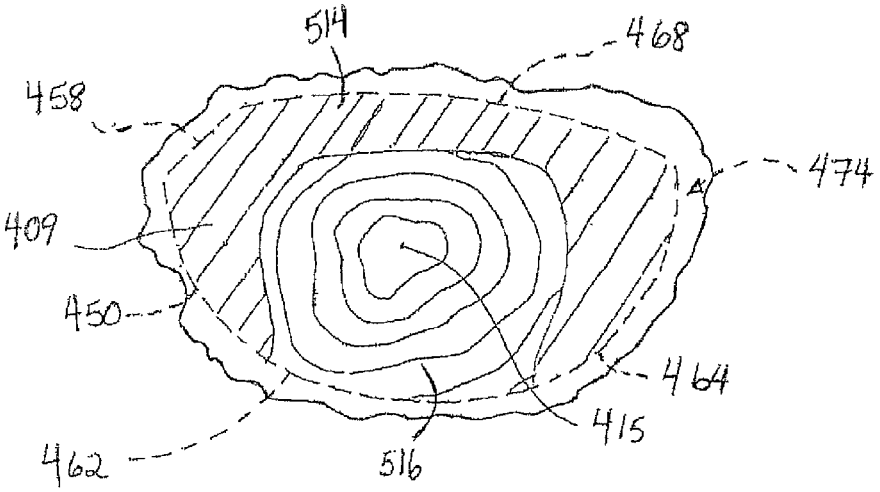
FIG. 13 is a rear elevational schematic view of a portion of an exemplary strike-face wall according to one or more aspects of the present invention.

Referring to FIG. 13, the strike-face wall of the golf club head 400, according to one or more aspects of the present invention, may alternatively have a uniform-thickness region 514 and a variable-thickness region 516. The uniform-thickness region 514 may adjoin at least a portion of the top inner boundary 468 and the intermediate inner boundary 458, as well as a majority of the bottom-inner-boundary heel portion 450 and the bottom-inner-boundary toe portion 464. Preferably, the uniform-thickness region 514 has a C-shaped configuration that substantially surrounds the variable-thickness region 516 and encompasses at least about 50% of the rear surface area of the strike-face wall within the inner boundary 474. The variable-thickness region 516 may adjoin the uniform-thickness region 514 and a minority of the bottom inner boundary 462. More specifically, the variable-thickness region 516 may preferably adjoin less than about 40% of the bottom inner boundary 462 and more preferably less than about 30% of the bottom inner boundary 462.

Figure 14:
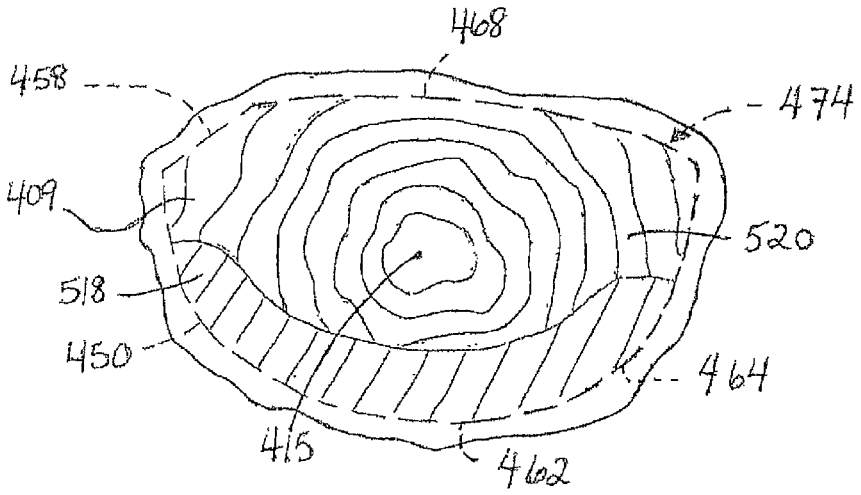
FIG. 14 is a rear elevational schematic view of a portion of an exemplary strike-face wall according to one or more aspects of the present invention.

As shown in FIG. 14, the strike-face wall of the golf club head 400, according to one or more aspects of the present invention, may alternatively have a uniform-thickness region 518 and a variable-thickness region 520. The uniform-thickness region 518 may preferably adjoin at least a portion of the bottom inner boundary 462 and, more preferably, may adjoin a majority of the bottom inner boundary 462. Accordingly, the uniform-thickness region 518 may adjoin a majority of at least one of the bottom-inner-boundary toe portion 464 and the bottom-inner-boundary heel portion 450. The variable-thickness region 520 may adjoin at least a portion of the uniform-thickness region 518, the top inner boundary 468, and the intermediate inner boundary 458, as well as a portion of the bottom-inner-boundary toe portion 464 and the bottom-inner-boundary heel portion 450. In one example, the variable-thickness region 520 may adjoin the entire top inner boundary 468 and the entire intermediate inner boundary 458.

Figure 15:
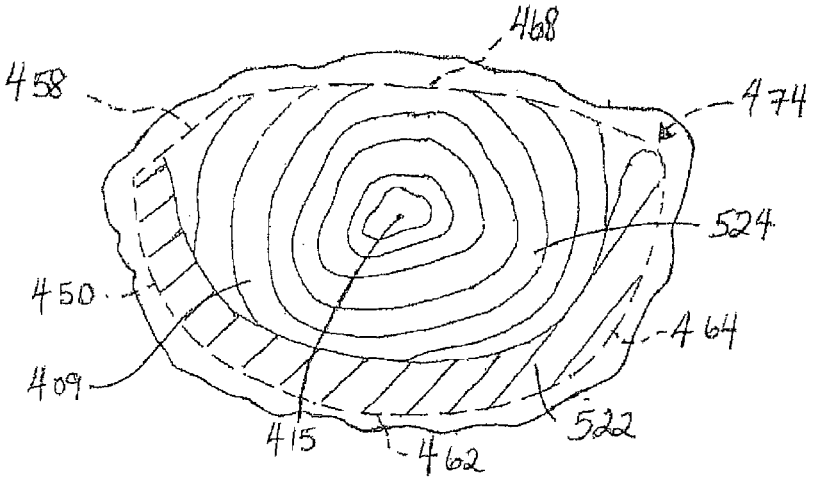
FIG. 15 is a rear elevational schematic view of a portion of an exemplary strike-face wall according to one or more aspects of the present invention.

Referring to FIG. 15, the strike-face wall of the golf club head 400, according to one or more aspects of the present invention, may alternatively have a uniform-thickness region 522 and a variable-thickness region 524. The uniform-thickness region 522 may preferably adjoin a majority of the bottom inner boundary 462, and, more preferably, may adjoin the entire bottom inner boundary 462. In one example, the uniform-thickness region 522 may additionally adjoin a portion of the intermediate inner boundary 458 and the top inner boundary 468. The variable-thickness region 524 may adjoin at least a portion of the uniform-thickness region 522, the top inner boundary 468, and the intermediate inner boundary 458. Preferably, the variable-thickness region 524 adjoins the majority of the top inner boundary 468.

Figure 16A:
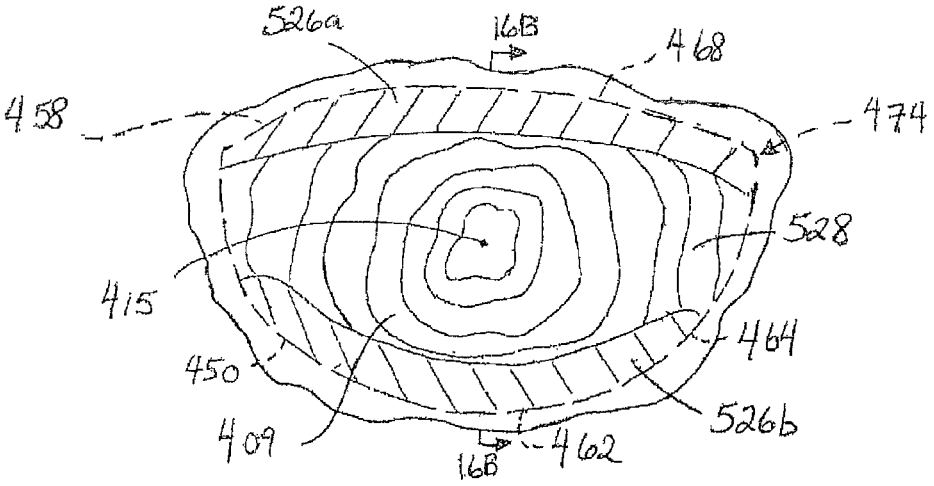
FIG. 16A is a rear elevational schematic view of a portion of an exemplary strike-face wall according to one or more aspects of the present invention.
Figure 16B:
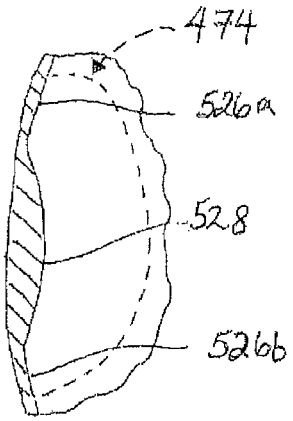
FIG. 16B is a cross-sectional view of the portion of the strike-face wall of FIG. 16A taken in the direction of the lines 16B-16B.

As shown in FIGS. 16A and 16B, the strike-face wall of the golf club head 400, according to one or more aspects of the present invention, may alternatively have a first uniform-thickness region 526*a*, a second uniform-thickness region 526*b*, and a variable-thickness region 528. The first uniform-thickness region 526*a* may adjoin at least a portion of the top inner boundary 468 and the intermediate inner boundary 458, as well as a portion of the bottom-inner-boundary toe portion 464 and/or the bottom-inner-boundary heel portion 450. In one example, the first-uniform-thickness region 526*a* may adjoin the entire top inner boundary 468 and the entire intermediate inner boundary 458. The second uniform-thickness region 526*b* may preferably adjoin a majority of the bottom inner boundary 462. Accordingly, the second uniform-thickness region 526*b* may adjoin a majority of at least one of the bottom-inner-boundary toe portion 464 and the bottom-inner-boundary heel portion 450. In another example, the second-uniform thickness region 526*b* may adjoin only a minority of the bottom inner boundary 462. The thicknesses of the regions 526*a* and 526*b* may be the same or different. The variable-thickness region 528 may adjoin the first uniform-thickness region 526*a*, the second uniform-thickness region 526*b*, a portion of the bottom-inner-boundary toe portion 464, and a portion of the bottom-inner-boundary heel portion 450. In one example, the variable-thickness region 528 may adjoin the majority of the bottom inner boundary 462 and may be dissociated from the top inner boundary 468. In another example, the variable-thickness region 528 may adjoin the minority of the bottom inner boundary 462.

Figure 17:
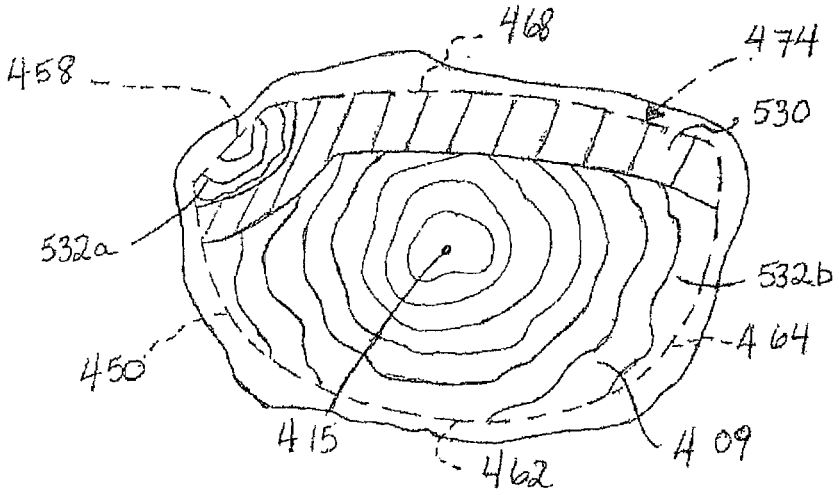
FIG. 17 is a rear elevational schematic view of a portion of an exemplary strike-face wall according to one or more aspects of the present invention.

As shown in FIG. 17, the strike-face wall of the golf club head 400, according to one or more aspects of the present invention, may alternatively have a uniform-thickness region 530, a first variable-thickness region 532*a*, and a second variable thickness region 532*b*. The uniform-thickness region 530 may adjoin at least a portion of the top inner boundary 468, a portion of the bottom-inner-boundary heel portion 450, and/or a portion of the bottom-inner-boundary toe portion 464. Preferably, the uniform-thickness region 530 is dissociated from the intermediate inner boundary 458. The first variable-thickness region 532*a* may adjoin at least a portion of the intermediate inner boundary 458 and may be separated from the second variable-thickness region 532*b* by a portion of the uniform-thickness region 530. In one example, the first variable-thickness region may adjoin the entire intermediate inner boundary 458 and may gradually taper from a first maximum thickness dimension, located generally proximate the intermediate inner boundary 458, toward the uniform-thickness region 530. The thickness of the region 532*a* may preferably range between about 1.5 mm and about 4 mm and, more preferably, may range between about 2 mm and about 3 mm. The second variable-thickness region 532*b* may adjoin the uniform-thickness region 530 and a majority of the bottom inner boundary 462. Preferably, the second variable-thickness region 532*b* tapers from a second maximum thickness dimension, located generally proximate the face center 415, toward the bottom inner boundary 462 and the uniform-thickness region 530. The thickness of the region 532*b* may range between about 2 mm and about 5 mm and, more preferably, may range between about 2.5 mm and about 3.8 mm. In one example, the second maximum thickness dimension of the region 532*b* may be greater than the first maximum thickness dimension of the region 532*a*. In another example, the first maximum thickness dimension of the region 532*a* may be greater than the second maximum thickness dimension of the region 532*b*.

Figure 18:
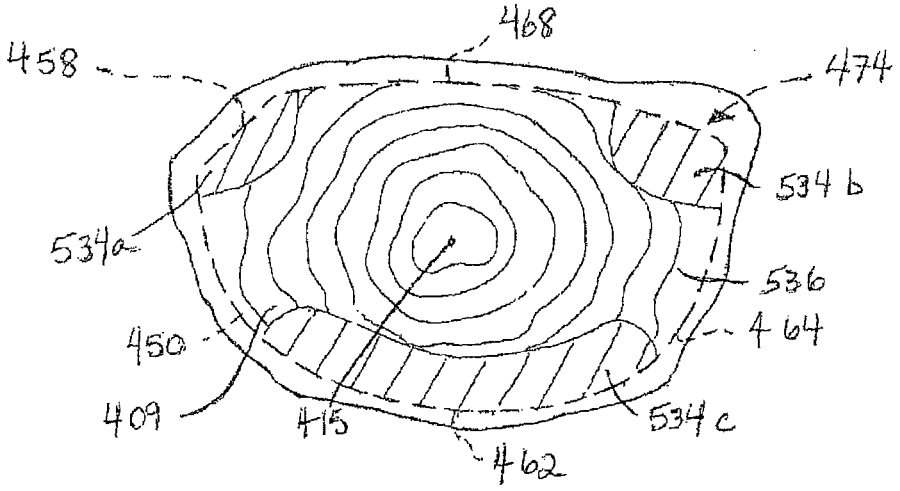
FIG. 18 is a rear elevational schematic view of a portion of an exemplary strike-face wall according to one or more aspects of the present invention.

As shown in FIG. 18, the strike-face wall of the golf club head 400, according to one or more aspects of the present invention, may alternatively have a first uniform-thickness region 534*a* second uniform-thickness region 534*b*, a third uniform-thickness region 534*c*, and a variable thickness region 536. The first uniform-thickness region 534*a* may adjoin a portion of the top inner boundary 468, a portion of the bottom-inner-boundary heel portion 450, and at least a portion of the intermediate inner boundary 458. In one example, the first uniform-thickness region 534*a* adjoins the entire intermediate inner boundary 458. The thickness of the region 534*a* may preferably be between about 1 mm and about 5 mm and, more preferably, may be between about 2 ram and about 4 mm. The second uniform-thickness region 534*b* may adjoin a portion of the top inner boundary 468 and the bottom-inner-boundary toe portion 464. The thickness of the region 534 *b* may preferably be between about 1 mm and about 5 mm and, more preferably, may be between about 2 mm and about 4 mm. The third uniform-thickness region 534*c* may adjoin a portion of the bottom inner boundary 462. In one example, the third-uniform-thickness region 534*c* may adjoin the majority of the bottom inner boundary 462. The thickness of the region 534*c* may preferably be between about 1 mm and about 5 mm and, more preferably, may be between about 2 mm and about 4 mm. The regions 534 *a-c* may be separated from each other by the variable-thickness region 536, which adjoins a portion of the top inner boundary 468, the bottom-inner-boundary toe portion 464, and the bottom-inner-boundary heel portion 450. Preferably, the variable-thickness region 536 adjoins a majority of the bottom inner boundary 462. In another aspect of the present invention, the regions 534 *a-c* may have substantially the same thickness. In other examples, at least two of the regions 534 *a-c* may have different thicknesses.

Figure 19A:
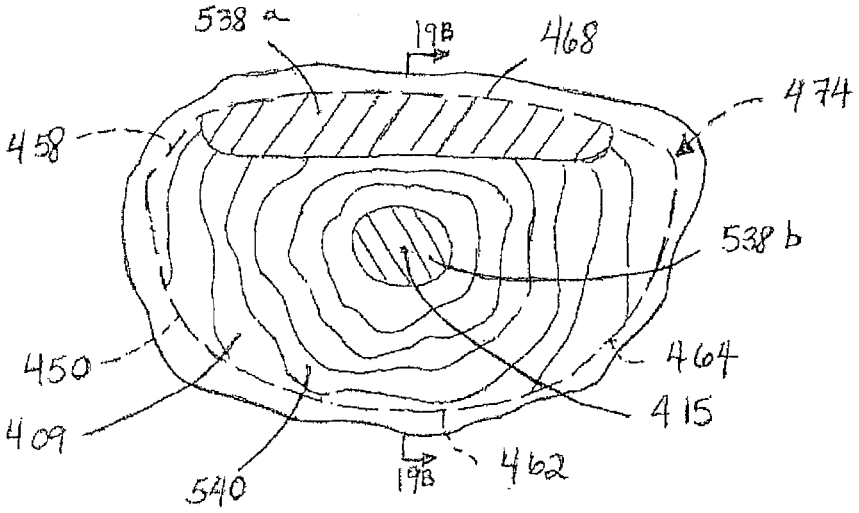
FIG. 19A is a rear elevational schematic view of a portion of an exemplary strike-face wall according to one or more aspects of the present invention.
Figure 19B:
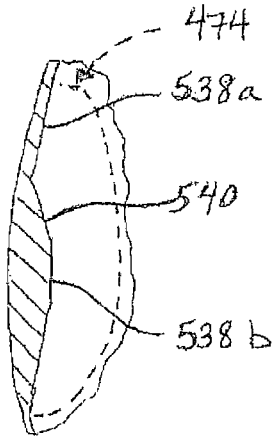
FIG. 19B is a cross-sectional view of the portion of the strike-face wall of FIG. 19A taken in the direction of the lines 19B-19B.

Referring to FIGS. 19A and 19B, the strike-face wall of the golf club head 400, according to one or more aspects of the present invention, may alternatively have a first uniform-thickness region 538*a*, a second uniform-thickness region 538*b*, and a variable-thickness region 540, The first uniform-thickness region 538*a* may preferably adjoin a portion of the top inner boundary 468 and, more preferably, may adjoin a majority of the top inner boundary 468. The thickness of the first-uniform thickness region 538*a* may be between about 1.5 mm and about 3 mm. The second uniform-thickness region 538*b* may be located proximate the face center 415 and may be dissociated from the top inner boundary 468, the intermediate inner boundary 458, and the bottom inner boundary 462. In one example, the region 538*b* is a substantially concentric region that is entirely surrounded by the variable-thickness region 540. Preferably, the region 538*b* has a thickness between about 2.5 mm and about 4 mm. The variable-thickness region 540 may adjoin the first uniform-thickness region 538*a*, the second uniform-thickness region 538*b*, a portion of the top inner boundary 468, at least a portion of the intermediate inner boundary 458, and a majority of the bottom inner boundary 462. Accordingly, the variable-thickness region 540 may separate the first uniform-thickness region 538*a* from the second uniform-thickness region 538*b*. Preferably, the thickness of the second uniform-thickness region 538*b* is greater than the thickness of the first uniform-thickness region 538*a*.

Figure 20:
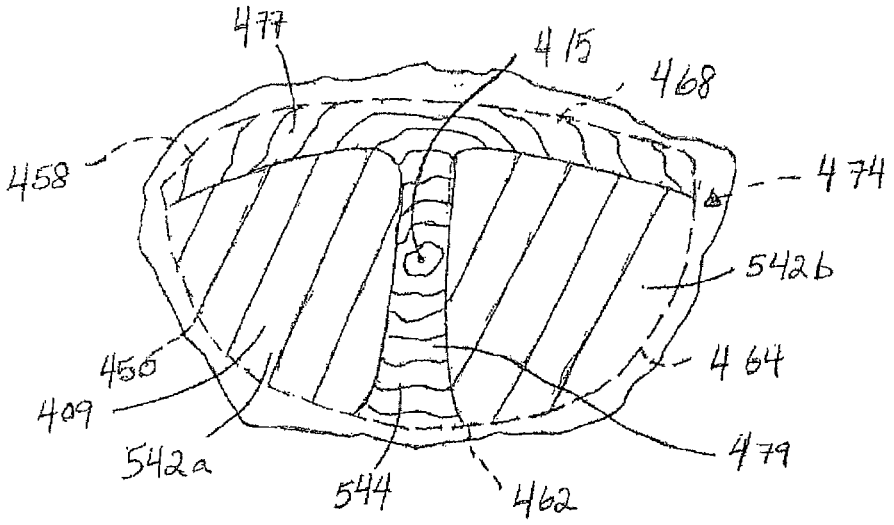
FIG. 20 is a rear elevational schematic view of a portion of an exemplary strike-face wall according to one or more aspects of the present invention.

Referring to FIG. 20, the strike-face wall of the golf club head 400, according to one or more aspects of the present invention, may alternatively have a first uniform-thickness region 542*a*, a second uniform-thickness region 542*b*, and a variable-thickness region 544. Preferably, the variable-thickness region 544 may have a T-shaped configuration comprising a generally horizontal upper portion 477 and a generally vertical lower portion 479 that separates the first uniform-thickness region 542*a* from the second uniform-thickness region 542*b*. The upper portion 477 may adjoin at least a portion of the top inner boundary 468 and the intermediate inner boundary 458, as well as a portion of the bottom-inner-boundary heel portion 450 and the bottom-inner-boundary toe portion 464. The lower portion 479 may adjoin a portion of the bottom inner boundary 462. In another aspect of the present invention, the lower portion 479 may adjoin a minority of the bottom inner boundary 462. The first uniform-thickness region 542*a* may adjoin the variable-thickness region 544 and a majority of the bottom-inner-boundary heel portion 450. Preferably, the thickness of the region 542*a* may be between about 2 mm and about 4 mm and, more preferably, the thickness of the region 542*a* may be between about 2.5 mm and about 3.4 mm. The second uniform-thickness region 542*b* may also adjoin the variable-thickness region 544 and a majority of the bottom-inner-boundary toe portion 464. The thickness of the region 542*b* may preferably be between about 2 mm and about 4 mm and, more preferably, may be between about 2.5 mm and about 3.4 mm. In one example, the regions 542*a* and 542*b* may have the same thickness. In another example, the regions 542*a* and 542*b* may have different thicknesses.

Figure 21:
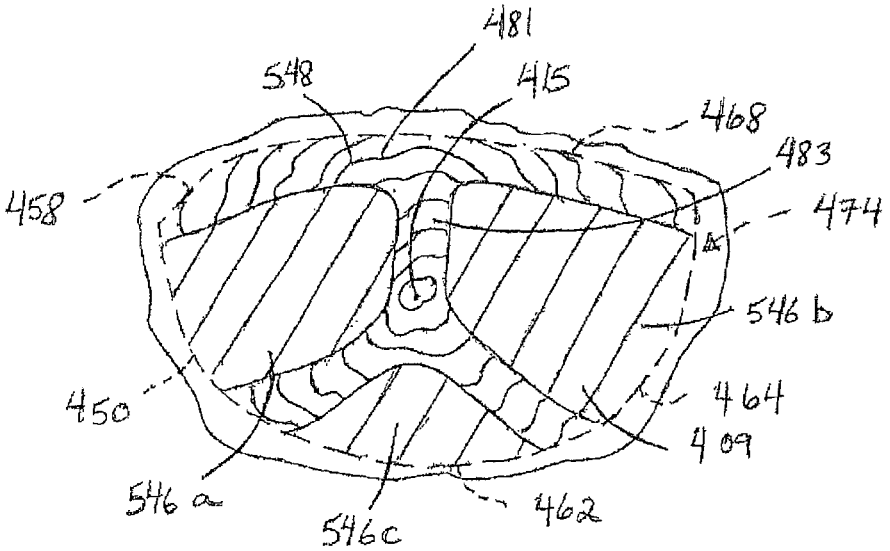
FIG. 21 is a rear elevational schematic view of a portion of an exemplary strike-face wall according to one or more aspects of the present invention.

As shown in FIG. 21, the strike-face wall of the golf club head 400, according to one or more aspects of the present invention, may alternatively have a first uniform-thickness region 546*a*, a second uniform-thickness region 546*b*, a third uniform-thickness region 546*c*, and a variable-thickness region 548. Preferably, the uniform-thickness regions 546 *a-c* may be separated from each other by the variable-thickness region 548, whereby the first uniform-thickness region 546*a* adjoins the majority of the bottom-inner-boundary heel portion 450, the second uniform-thickness region 546*b* adjoins the majority of the bottom-inner-boundary toe portion 464, and the third uniform-thickness region 546*c* adjoins a portion of both the bottom-inner-boundary heel portion 450 and the bottom-inner-boundary toe portion 464. In one example, at least two of the regions 546 *a-c* may encompass the same percentage of the rear surface area of the strike-face wall within the inner boundary 474. In another example, each region 546 *a-c* may encompass a different percentage of the rear surface area of the strike-face wall within the inner boundary 474. The variable-thickness region 548 may include a generally horizontal upper portion 481 and a Y-shaped lower portion 483. The upper portion 481 may adjoin at least a portion of the top inner boundary 468 and the intermediate inner boundary 458, as well as a portion of the bottom-inner-boundary heel portion 450 and the bottom-inner-boundary toe portion 464. The lower portion 483 may adjoin a portion of the generally horizontal upper portion 481, the bottom-inner-boundary toe portion 464, and the bottom-inner-boundary heel portion 450.

Figure 22:
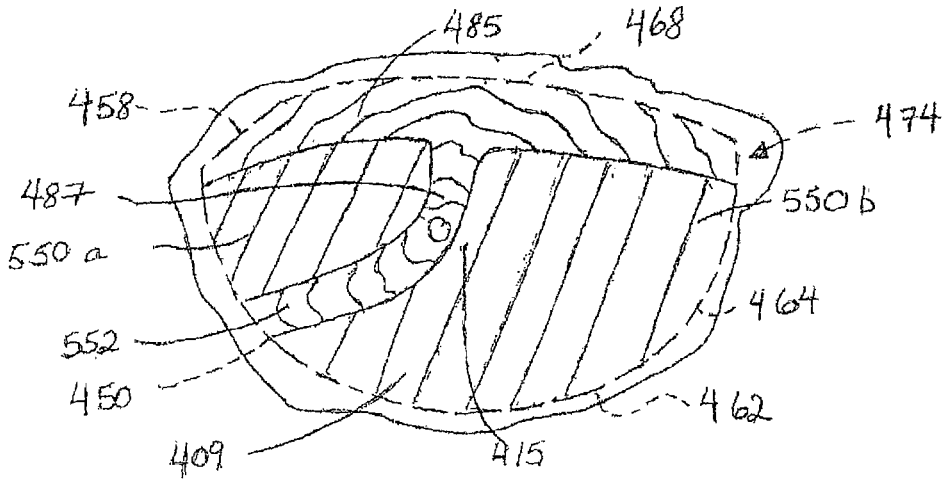
FIG. 22 is a rear elevational schematic view of a portion of an exemplary strike-face wall according to one or more aspects of the present invention.

Referring to FIG. 22, the strike-face wall of the golf club head 400, according to one or more aspects of the present invention, may alternatively have a first uniform-thickness region 550*a*, a second uniform-thickness region 550*b*, and a variable-thickness region 552. Preferably, the variable-thickness region 552 may include a generally horizontal upper portion 485 and an at least partially curvilinear lower portion 487 that separates the first uniform-thickness region 550*a* from the second uniform-thickness region 550*b*. The upper portion 485 may adjoin at least a portion of the top inner boundary 468 and the intermediate inner boundary 458, as well as a portion of the bottom-inner-boundary heel portion 450 and the bottom-inner-boundary toe portion 464. The lower portion 487 may adjoin the upper portion 489 and a portion of the bottom-inner-boundary heel portion 450. The first uniform-thickness region 550*a* may adjoin the variable-thickness region 552 and a minority of the bottom inner boundary 462. The thickness of the region 550*a* may preferably be between about 2 mm and about 4 mm and, more preferably, may be between about 2.5 mm and about 3.8 mm. The second uniform-thickness region 550*b* may adjoin the variable-thickness region 552 and a majority of the bottom inner boundary 462. The thickness of the region 550*b* may preferably be between about 2 mm and about 4 mm and, more preferably, may be between about 2.5 mm and about 3.8 mm. In one example, the face center 415 may be disposed in the second-uniform thickness region 550*b*. Preferably, the rear surface area encompassed by the first uniform-thickness region 550*a* within the inner boundary 474 is less than the rear surface area encompassed by the second uniform-thickness region 550*b* within the inner boundary 474.

Figure 23:
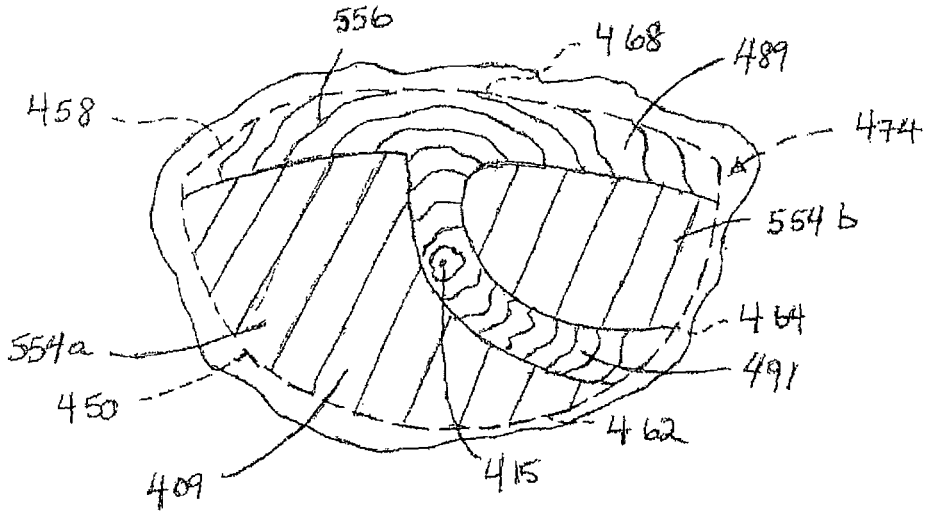
FIG. 23 is a rear elevational schematic view of a portion of an exemplary strike-face wall according to one or more aspects of the present invention.

Referring to FIG. 23, the strike-face wall of the golf club head 400, according to one or more aspects of the present invention, may alternatively have a first uniform-thickness region 554*a*, a second uniform-thickness region 554*b*, and a variable-thickness region 556. Preferably, the variable-thickness region 556 may include a generally horizontal upper portion 489 and an at least partially curvilinear lower portion 491 that separates the first uniform-thickness region 554*a* from the second uniform-thickness region 554*b*. The upper portion 489 may adjoin at least a portion of the top inner boundary 468 and the intermediate inner boundary 458, as well as a portion of the bottom-inner-boundary heel portion 450 and the bottom-inner-boundary toe portion 464. The lower portion 491 may adjoin the upper portion 489 and a portion of the bottom-inner-boundary toe portion 450. The first uniform-thickness region 554*a* may adjoin the variable-thickness region 556 and a majority of the bottom inner boundary 462. The thickness of the region 554*a* may preferably be between about 2 mm and about 4 mm and, more preferably, may be between about 2.5 mm and about 3.8 mm. The second uniform-thickness region 554*b* may adjoin the variable-thickness region 556 and a minority of the bottom inner boundary 462. The thickness of the region 554*b* may preferably be between about 2 mm and about 4 mm and, more preferably, may be between about 2.5 mm and about 3.8 mm. In one example, the face center 415 may be disposed in the first-uniform thickness region 554*b*. Preferably, the rear surface area encompassed by the first uniform-thickness region 554*a* within the inner boundary 474 is greater than the rear surface area encompassed by the second uniform-thickness region 554*b* within the inner boundary 474.

Figure 24A:
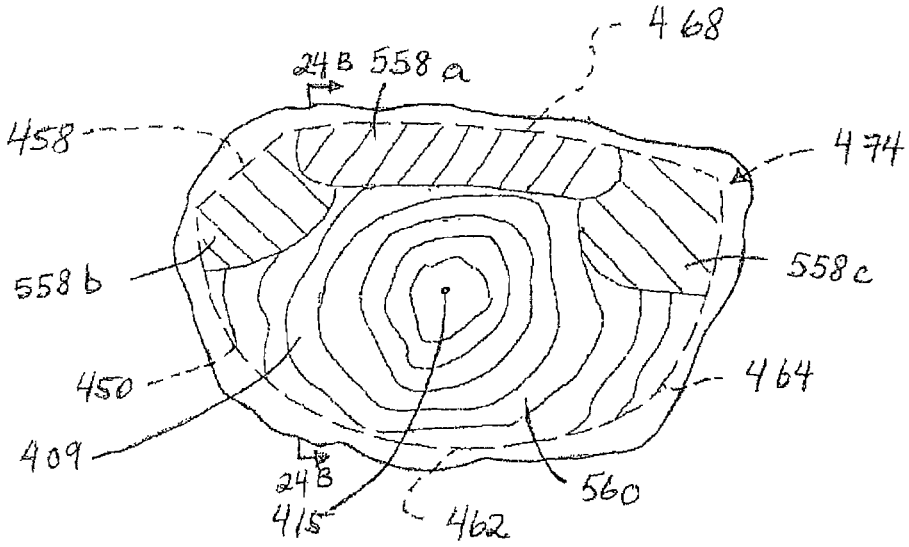
FIG. 24A is a rear elevational schematic view of a portion of an exemplary strike-face wall according to one or more aspects of the present invention.
Figure 24B:
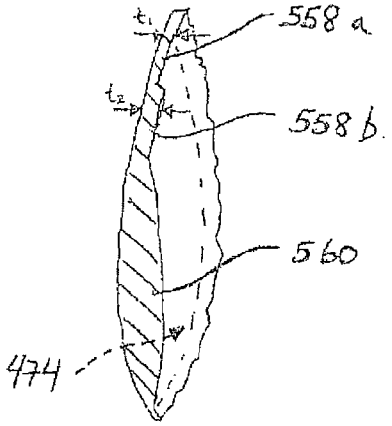
FIG. 24B is a cross-sectional view of the portion of the strike-face wall of FIG. 24A taken in the direction of the lines 24B-24B.

As shown in FIGS. 24A and 24B, the strike-face wall of the golf club head 400, according to one or more aspects of the present invention, may alternatively have a first uniform-thickness region 558*a*, a second uniform-thickness region 558*b*, a third uniform-thickness region 558*c*, and a variable thickness region 560. The first uniform-thickness region 558*a* may preferably adjoin a portion of the top inner boundary 468 and, more preferably, may adjoin a majority of the top inner boundary 468. The thickness of the region 558*a* may, e.g., be between about 2 mm and about 5 mm. In another example, the region 558*a* may have a thickness between about 2.5 mm and about 4 mm. The second uniform-thickness region 558*b* may adjoin the first uniform-thickness region 558*a*, a portion of the top inner boundary 568, at least a portion of the intermediate inner boundary 458, and a portion of the bottom-inner-boundary heel portion 450. Preferably, the region 558*b* comprises a thickness that is greater than the region 558*a*. Accordingly, a first stepped portion may separate the first uniform-thickness region 558*a* from the second uniform-thickness region 558*b*. The third uniform-thickness region 558*c* may adjoin the first uniform-thickness region 558*a*, a portion of the top inner boundary 558*a*, and a portion of the bottom-inner-boundary toe portion 464. The region 558*c* may also comprise a thickness that is greater than the region 558*a*. Accordingly, a second stepped portion may separate the first uniform-thickness region 558*a* from the third uniform-thickness region 558*c*. In another aspect of the present invention, the regions 558*b* and 558*c* may have a thickness that is less than the region 558*a*. Additionally, the regions 558 *a-c* may each have a different thickness. The variable-thickness region 560 may adjoin the first uniform-thickness region 558*a*, the second uniform-thickness region 558*b*, the third uniform-thickness region 558*c*, and a majority of the bottom inner boundary 462.

Figure 25:
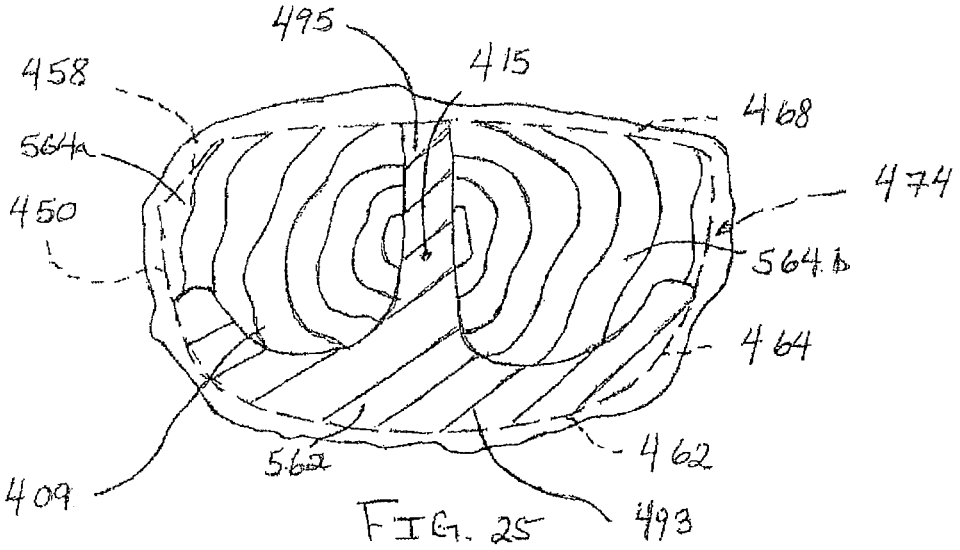
FIG. 25 is a rear elevational schematic view of a portion of an exemplary strike-face wall according to one or more aspects of the present invention.

Referring to FIG. 25, the strike-face wall of the golf club head 400, according to one or more aspects of the present invention, may alternatively have a uniform-thickness region 562, a first variable-thickness region 564*a*, and a second variable-thickness region 564*b*. The uniform-thickness region 562 may have a T-shaped configuration comprising a lower portion 493 and a generally vertical upper portion 495 that separates the first variable-thickness region 564*a* from the second variable-thickness region 564*b*. The lower portion 493 may adjoin a majority of the bottom inner boundary 462. The upper portion 495 may adjoin the lower portion 493 and a portion of the top-inner boundary 468. Preferably, the face center 415 is disposed in the lower portion 493. The first variable-thickness region 564*a* may adjoin a portion of the top inner boundary 468, at least a portion of the intermediate inner boundary 458, and a portion of the bottom-inner-boundary heel portion 450. The second variable-thickness region 564*b* may adjoin a portion of the top inner boundary 468 and a portion of the bottom-inner-boundary toe portion 464. In one aspect of the present invention, the thickness uniform-thickness region 562 may comprise the maximum thickness dimension.

In the foregoing specification, the invention has been described with reference to specific exemplary aspects thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A wood-type golf club head comprising:

a strike-face wall comprising:

a front surface including a face center, an outer boundary, and an inner boundary defined by all points displaced, in a direction of the face center, from the outer boundary by a constant offset that is between about 0.5 mm and about 15 mm a face boundary, the inner boundary including a top boundary portion, a bottom boundary portion opposite the top boundary portion, a toe boundary portion, and a heel boundary portion opposite the toe boundary portion;

a rear surface;

a first continuous uniform-thickness region extending from the toe boundary portion and having a first thickness;

a second continuous uniform-thickness region extending from the heel boundary portion and having a second thickness;

a third continuous uniform-thickness region extending from the bottom boundary portion and having a third thickness; and a variable-thickness region adjoining, and thickened relative to the first, second, and third uniform-thickness regions, the variable-thickness region contacting both the top boundary portion and the bottom boundary portion, the variable-thickness region separating the first continuous uniform-thickness region from the second continuous uniform-thickness region and separating each of the first continuous uniform-thickness region and the second continuous uniform-thickness region from the third continuous uniform-thickness region, wherein the variable-thickness has a fourth thickness greater than the first, second, and third thicknesses.

2. The wood-type golf club head of claim 1, wherein the variable-thickness region is continuously variable.

3. The wood-type golf club head of claim 1, wherein the first thickness, the second thickness, and the third thickness are each less than about 3 mm.

4. The wood-type golf club head of claim 1, wherein the variable-thickness region includes a first segment extending from the bottom boundary portion near the toe boundary portion and distal the heel boundary portion and a second segment extending from the bottom boundary portion near the heel boundary portion and distal the toe boundary portion.

5. The wood-type golf club head of claim 4, wherein the first segment and the second segment converge.

6. The wood-type golf club head of claim 5, wherein the variable-thickness region further includes a third segment adjoining the top boundary portion, a fourth segment adjoining the top boundary portion, and a fifth segment contacting each of the first, second, third, and fourth segments.

7. The wood-type golf club head of claim 1, wherein the variable-thickness thickness region extends between the top boundary portion and the bottom boundary portion and includes the face center.

8. The wood-type golf club head of claim 1, wherein a maximum thickness dimension is located proximate the face center.

9. The wood-type golf club head of claim 7, wherein the maximum thickness dimension is less than 5 mm.

10. The wood-type golf club head of claim 1, wherein the fourth thickness is between 2 mm and 4 mm.

11. A wood-type golf club head comprising:

a strike-face wall comprising:

a front surface including a face center, an outer boundary, and an inner boundary defined by all points displaced, in a direction of the face center, from the outer boundary by a constant offset that is between about 0.5 mm and about 15 mm, the inner boundary including a top inner boundary portion, a bottom inner boundary portion opposite the top inner boundary portion, a toe inner boundary portion, and a heel inner boundary portion opposite the toe inner boundary portion;

a rear surface;

a first continuous uniform-thickness region adjoining the toe inner boundary and comprising a first thickness;

a second continuous uniform-thickness region adjoining the heel inner boundary and comprising a second thickness;

a third continuous uniform-thickness region adjoining the bottom inner boundary and comprising a third thickness; and a variable-thickness region adjoining, and thinned relative to the first uniform-thickness region, the second uniform-thickness region, and the third uniform-thickness region and including the face center, wherein the variable-thickness region comprises a fourth thickness less than the first, second, and third thicknesses and extends between the top inner boundary portion and the bottom inner boundary portion.

12. The wood-type golf club head of claim 11, wherein a minimum thickness dimension is located proximate the face center.

13. The wood-type golf club head of claim 11, wherein a maximum thickness dimension is located in at least one of the first uniform-thickness region, the second uniform-thickness region, and the third uniform-thickness region.

14. The wood-type golf club head of claim 11, wherein the variable-thickness region is continuously variable.

15. The wood-type golf club head of claim 11, wherein the first thickness, the second thickness, and the third thickness are each less than about 5 mm.

16. The wood-type golf club head of claim 11, wherein the variable-thickness region includes a first segment extending from the bottom inner boundary portion near the toe inner boundary portion and distal the heel inner boundary portion and a second segment extending from the bottom inner boundary portion near the heel inner boundary portion and distal the toe inner boundary portion.

17. The wood-type golf club head of claim 16, wherein the first segment and the second segment converge.

18. The wood-type golf club head of claim 17, wherein the variable-thickness region further includes a third segment adjoining the top inner boundary portion, a fourth segment adjoining the top inner boundary portion, and a fifth segment contacting each of the first, second, third, and fourth segments.

19. The wood-type golf club head of claim 11, wherein the variable-thickness thickness region includes the face center.

20. The wood-type golf club head of claim 11, wherein the fourth thickness is between 2 mm and 4 mm.

* * * * *